US008720682B2

(12) United States Patent
Navon et al.

(10) Patent No.: US 8,720,682 B2
(45) Date of Patent: May 13, 2014

(54) HOLDERS FOR PORTABLE MEMORY CARDS AND METHODS FOR MANUFACTURING SAME

(75) Inventors: Ariel Navon, Hod-Hasharon (IL); Itzhak Pomerantz, Kefar Sava (IL); Rahav Yairi, Granit (IL)

(73) Assignee: Sandisk IL Ltd., Kfar Saba (IL)

( * ) Notice: Subject to any disclaimer, the term of this patent is extended or adjusted under 35 U.S.C. 154(b) by 0 days.

(21) Appl. No.: 12/866,451

(22) PCT Filed: Sep. 16, 2009

(86) PCT No.: PCT/IB2009/006853

§ 371 (c)(1),
(2), (4) Date: Aug. 5, 2010

(87) PCT Pub. No.: WO2011/030176

PCT Pub. Date: Mar. 17, 2011

(65) Prior Publication Data

US 2012/0152774 A1 Jun. 21, 2012

Related U.S. Application Data

(60) Provisional application No. 61/240,999, filed on Sep. 9, 2009.

(51) Int. Cl.
*B65D 85/00* (2006.01)

(52) U.S. Cl.
USPC ..... 206/320; 206/307; 206/460

(58) Field of Classification Search
USPC ..... 206/307, 320, 308.1, 308.3, 460, 1.5, 206/232
See application file for complete search history.

(56) References Cited

U.S. PATENT DOCUMENTS

| | | | |
|---|---|---|---|
| 1,213,816 | A | 1/1917 | Ballentine |
| 1,436,484 | A | 11/1922 | Dahl |
| 1,451,279 | A | 4/1923 | Strietelmeier |

(Continued)

FOREIGN PATENT DOCUMENTS

| | | |
|---|---|---|
| DE | 20 2004 013 233 | 10/2004 |
| EP | 0 831 412 A2 | 3/1998 |

(Continued)

OTHER PUBLICATIONS

International Search Report for International Application No. PCT/IB2009/006853 (May 7, 2010).

(Continued)

*Primary Examiner* — Luan K Bui
(74) *Attorney, Agent, or Firm* — Jenkins, Wilson, Taylor & Hunt, P.A.

(57) ABSTRACT

Holders for portable memory cards and methods for manufacturing such holders are provided. A holder for a portable memory card described herein is configured to attach to a host device such that a portable memory card can travel with a host even when the portable memory card is not being used with the host. A holder for a portable memory card described herein may have a low profile design compatible with host electronic devices of increasingly small form factor, such as mobile phones and portable media players. A holder for a portable memory card may also include a lock for locking a portable memory card in a compartment formed by the memory card holder to prevent accidental removal of the portable memory card from the compartment.

9 Claims, 22 Drawing Sheets

(56) References Cited

U.S. PATENT DOCUMENTS 1,652,842 A 12/1927 Tanner
1,670,343 A 5/1928 Clemens
2,185,624 A 1/1940 Beck
2,334,487 A 11/1943 Greenway
D140,900 S 4/1945 Behrman
3,029,537 A 4/1962 Hopp et al.
3,294,222 A 12/1966 Hodgson
D209,035 S 10/1967 Robert
D209,629 S 12/1967 Brockway
D214,819 S 7/1969 Goldberg
3,615,006 A 10/1971 Freed
3,749,230 A 7/1973 Foster
3,767,110 A 10/1973 Congleton
D230,569 S 3/1974 Fallowfield et al.
3,891,070 A 6/1975 Montanari
D237,419 S 10/1975 Lapins et al.
3,954,179 A 5/1976 Warmath
D249,825 S 10/1978 Hasulak
4,141,400 A 2/1979 Mangan
4,331,194 A 5/1982 Lederer
4,345,607 A 8/1982 Contreras et al.
D274,065 S 5/1984 Goutchat
4,454,889 A 6/1984 Contreras, Sr.
D278,097 S 3/1985 Akiyoshi
4,518,080 A 5/1985 Ohlson
4,521,981 A 6/1985 Kasprzycki et al.
D281,033 S 10/1985 Mohri
D285,177 S 8/1986 Goetz
D288,983 S 3/1987 Juhas et al.
4,697,698 A 10/1987 Holdener
4,700,840 A 10/1987 Haddock
4,703,853 A 11/1987 Byrns
4,746,045 A 5/1988 Schweim
4,778,047 A 10/1988 Lay
4,791,608 A 12/1988 Fushimoto
4,817,819 A 4/1989 Kelly
4,852,727 A 8/1989 Oberle
4,863,034 A 9/1989 Contreras, Sr.
D308,913 S 7/1990 Kirchner
D309,431 S 7/1990 Sheehan
4,974,983 A 12/1990 Givati
D313,698 S 1/1991 Duffy
D314,865 S 2/1991 Tuisku
5,038,926 A 8/1991 van der Toorn
5,050,623 A 9/1991 Yuhara et al.
5,069,333 A 12/1991 Chen
5,080,223 A 1/1992 Mitsuyama
5,094,396 A 3/1992 Burke
5,115,931 A 5/1992 Dubach
D328,526 S 8/1992 Bianchi, Jr. et al.
D332,684 S 1/1993 Melamed
5,183,153 A 2/1993 Linn
D333,727 S 3/1993 Schurman
5,217,056 A 6/1993 Ritter
D337,656 S 7/1993 Hostert
5,234,351 A 8/1993 Dixon
5,291,990 A 3/1994 Sejzer
5,293,995 A 3/1994 Iwaki et al.
D347,728 S 6/1994 Taniyama
D352,601 S 11/1994 Dallaire
5,385,235 A * 1/1995 Ikebe et al. ..... 206/307
D358,055 S 5/1995 Long et al.
5,467,871 A 11/1995 DeField
5,493,105 A 2/1996 Desai
5,531,322 A 7/1996 Iwaki et al.
5,540,328 A 7/1996 Kohtake
5,544,438 A 8/1996 Fazekas
D375,429 S 11/1996 Staack et al.
5,592,767 A 1/1997 Treske
5,620,271 A 4/1997 Bergh et al.
D379,830 S 6/1997 Wasylyk
5,638,838 A 6/1997 Lombardi
D380,493 S 7/1997 Sanders
5,678,204 A * 10/1997 Naylor ..... 206/305
5,692,438 A 12/1997 Kanai
5,697,498 A 12/1997 Weisburn et al.
D390,357 S 2/1998 Rosen
D391,760 S 3/1998 Zeller
5,727,681 A 3/1998 Li
5,740,624 A 4/1998 Baseley
5,740,938 A 4/1998 Hofmann et al.
5,749,464 A 5/1998 Cheris et al.
5,752,615 A 5/1998 Hofmann et al.
5,782,352 A 7/1998 Senda
5,791,474 A 8/1998 Hansen
D397,870 S 9/1998 De Winter
5,826,719 A 10/1998 Chen
5,829,583 A 11/1998 VerWeyst et al.
D403,152 S 12/1998 Parad
5,842,486 A 12/1998 Davis et al.
5,865,310 A 2/1999 Lee
D406,192 S 3/1999 Schurman
5,878,878 A 3/1999 Wu
5,884,764 A 3/1999 Hartstone
5,890,693 A 4/1999 Do et al.
5,901,764 A 5/1999 Ritter
5,929,427 A 7/1999 Harada et al.
5,938,242 A 8/1999 Ryan
5,941,375 A 8/1999 Kamens et al.
D413,440 S 9/1999 Schurman
D413,753 S 9/1999 Allsop
5,984,441 A 11/1999 Stokhuijzen
D419,359 S 1/2000 Eguchi et al.
6,016,954 A 1/2000 Abe et al.
6,019,219 A * 2/2000 Takahashi ..... 206/307
6,021,901 A 2/2000 Wolfe
6,029,811 A 2/2000 Heiligers
6,050,014 A 4/2000 Ohlson
D425,294 S 5/2000 Haverstick
6,089,289 A 7/2000 Florjancic
6,120,228 A 9/2000 Exline
6,121,544 A 9/2000 Petsinger
D431,719 S 10/2000 Mucarquer
D431,881 S 10/2000 Gavin
6,155,410 A 12/2000 Davis
6,170,658 B1 1/2001 Dering
6,170,753 B1 1/2001 Takemura
6,186,403 B1 2/2001 Ozbey et al.
6,199,559 B1 3/2001 Nikolaus et al.
6,199,689 B1 3/2001 Higuchi et al.
6,223,754 B1 5/2001 Burdi et al.
6,230,885 B1 5/2001 Rochello et al.
6,266,905 B1 7/2001 Forsythe et al.
6,275,383 B1 8/2001 Böhm
6,283,298 B1 9/2001 Seidler
D456,201 S 4/2002 Hummell et al.
6,409,360 B2 6/2002 Contant et al.
6,427,837 B1 8/2002 Shields
D468,199 S 1/2003 Lambelet, Jr. et al.
D470,657 S 2/2003 Kawamura
D470,658 S 2/2003 Chunn et al.
6,571,940 B2 6/2003 Newman
D477,143 S 7/2003 Nagata et al.
D477,745 S 7/2003 Shamoon
6,594,154 B1 7/2003 Brewer et al.
D478,689 S 8/2003 Thorpe
6,648,166 B2 11/2003 Levy
D484,352 S 12/2003 Palmer
6,715,795 B2 4/2004 Klure
6,739,452 B2 5/2004 Rochelo
6,766,952 B2 7/2004 Luu
6,782,998 B2 8/2004 Koren
D497,074 S 10/2004 Dardashti
D497,508 S 10/2004 Dardashti
6,824,006 B2 11/2004 Lambelet, Jr.
6,845,863 B1 1/2005 Riley
6,848,577 B2 2/2005 Kawamura et al.
6,863,537 B2 3/2005 Pellizari
6,881,086 B2 4/2005 Ohashi
6,934,159 B2 8/2005 Nogami
6,947,290 B2 9/2005 Hirata
6,971,520 B2 12/2005 Fulda
6,991,155 B2 1/2006 Burchette, Jr.
D514,308 S 2/2006 Wahl et al.

(56) References Cited

U.S. PATENT DOCUMENTS

| | | | |
|---|---|---|---|
| 7,052,295 | B1 | 5/2006 | Lin |
| 7,059,911 | B2 | 6/2006 | Uchida et al. |
| 7,066,386 | B2 | 6/2006 | Izumi |
| D525,069 | S | 7/2006 | Farrar et al. |
| 7,093,736 | B2 | 8/2006 | Maietta et al. |
| RE39,311 | E | 10/2006 | Davis et al. |
| D531,025 | S | 10/2006 | Tanner |
| 7,161,747 | B2 | 1/2007 | Yang, Jr. |
| 7,161,811 | B2 | 1/2007 | Richter |
| 7,163,152 | B2 | 1/2007 | Osborn et al. |
| 7,172,127 | B1 | 2/2007 | Poland |
| 7,191,899 | B2 | 3/2007 | Garcia, Jr. et al. |
| 7,275,678 | B2 | 10/2007 | Hodsdon et al. |
| 7,293,647 | B2 | 11/2007 | Wong et al. |
| 7,296,716 | B2 | 11/2007 | Mayzel |
| 7,306,159 | B1 | 12/2007 | Rochelo |
| 7,308,771 | B2 | 12/2007 | Memelink |
| 7,325,744 | B2 | 2/2008 | Porter |
| 7,337,979 | B2 | 3/2008 | Takao |
| D565,842 | S | 4/2008 | Falcone |
| D566,395 | S | 4/2008 | Langer et al. |
| D567,032 | S | 4/2008 | Gilbert |
| 7,350,642 | B2 | 4/2008 | Bjerregaard et al. |
| D569,103 | S | 5/2008 | Hoge et al. |
| D573,637 | S | 7/2008 | Bharma |
| 7,469,787 | B2 | 12/2008 | Yuhara |
| 7,475,816 | B1 | 1/2009 | Rochelo |
| 7,520,425 | B2 | 4/2009 | Clegg |
| 7,533,826 | B2 | 5/2009 | Phillips |
| 7,556,205 | B2 | 7/2009 | Tsang |
| 7,568,928 | B2 | 8/2009 | Hou et al. |
| 7,578,446 | B2 | 8/2009 | Yen |
| 7,583,514 | B2 | 9/2009 | Zuo et al. |
| 7,614,548 | B2 | 11/2009 | Schultz et al. |
| D613,293 | S | 4/2010 | Sheba |
| 8,047,363 | B2 | 11/2011 | Sheba et al. |
| 2001/0053634 | A1 | 12/2001 | Camacho |
| 2002/0056652 | A1 | 5/2002 | Kawamura et al. |
| 2002/0061672 | A1 | 5/2002 | Burkart |
| 2002/0117243 | A1 | 8/2002 | Koren |
| 2002/0129527 | A1 | 9/2002 | Vaudreuil |
| 2003/0059248 | A1 | 3/2003 | Walton |
| 2003/0062275 | A1 | 4/2003 | Rochelo |
| 2003/0101630 | A1 | 6/2003 | Garcia et al. |
| 2004/0026275 | A1 | 2/2004 | Margetts et al. |
| 2004/0050939 | A1 | 3/2004 | Mathias et al. |
| 2004/0058576 | A1 | 3/2004 | Pellizari |
| 2004/0079656 | A1 | 4/2004 | Hoogland |
| 2004/0124248 | A1 | 7/2004 | Selker |
| 2004/0245128 | A1 | 12/2004 | MacColl et al. |
| 2005/0040057 | A1 | 2/2005 | Hoogland |
| 2005/0072691 | A1* | 4/2005 | Schlansky ..... 206/320 |
| 2005/0155879 | A1 | 7/2005 | Hoogland |
| 2005/0167302 | A1 | 8/2005 | Bjerregaard et al. |
| 2005/0180811 | A1 | 8/2005 | Workman et al. |
| 2005/0199710 | A1 | 9/2005 | Richter |
| 2005/0258068 | A1 | 11/2005 | Chien |
| 2005/0279655 | A1 | 12/2005 | Chen |
| 2006/0099855 | A1 | 5/2006 | Richter et al. |
| 2006/0102728 | A1 | 5/2006 | Miyazaki |
| 2006/0124747 | A1 | 6/2006 | Rathbun et al. |
| 2006/0144751 | A1 | 7/2006 | Tsang |
| 2006/0190738 | A1 | 8/2006 | Takao |
| 2006/0208062 | A1 | 9/2006 | Osborn et al. |
| 2007/0063329 | A1 | 3/2007 | Liu et al. |
| 2007/0089999 | A1 | 4/2007 | Decker et al. |
| 2007/0205115 | A1 | 9/2007 | Lee |
| 2007/0284264 | A1 | 12/2007 | Davis |
| 2008/0011628 | A1 | 1/2008 | Lin |
| 2008/0156676 | A1 | 7/2008 | Verma |
| 2008/0166898 | A1 | 7/2008 | Hubert et al. |
| 2008/0272191 | A1 | 11/2008 | Yen |
| 2008/0310094 | A1 | 12/2008 | Burns |
| 2009/0000969 | A1 | 1/2009 | Walker et al. |
| 2009/0101255 | A1 | 4/2009 | Long |

FOREIGN PATENT DOCUMENTS

| | | | |
|---|---|---|---|
| EP | 1947919 | A2 | 7/2008 |
| EP | 2034424 | A1 | 3/2009 |
| JP | 2003-034359 | | 2/2003 |
| JP | 2005-135305 | | 5/2005 |
| TW | 201113896 | | 4/2011 |
| WO | WO 2005/036342 | A2 | 4/2005 |

OTHER PUBLICATIONS

Communication of European Publication Number and Information on the Application of Article 67(3) EPC for European Application No. 09786255.1 (Jun. 20, 2012).

Notification Concerning Transmittal of International Preliminary Report on Patentability for International Application No. PCT/IB2009/006853 (Mar. 22, 2012).

Office Action for European Patent Application No. 09786255.1 (Feb. 20, 2013).

* cited by examiner

HOLDERS FOR PORTABLE MEMORY CARDS AND METHODS FOR MANUFACTURING SAME

PRIORITY CLAIM

This application claims the benefit of U.S. Provisional Patent Application Ser. No. 61/240,999, filed Sep. 9, 2009; the disclosure of which is incorporated herein by reference in its entirety.

TECHNICAL FIELD

The subject matter described herein relates to holders for portable memory cards. More particularly, the subject matter described herein relates to low profile holders for portable memory cards that attach to host devices and methods for manufacturing such holders.

BACKGROUND

Portable memory cards are increasingly being used to provide removable storage for host devices, including media players, mobile telephones, personal digital assistants (PDAs), smart phones, portable radios, global positioning system (GPS) devices, digital cameras, and combinations thereof. Most of these host devices typically hold a single removable, portable memory card. However, in some instances, a user may desire to carry additional portable memory cards. For example, portable memory cards that are preloaded with music are increasingly being used in portable media players. A user may desire to play the media on one portable memory card while carrying one or more additional portable memory cards with different media to which the user desires listen at a later time. One problem with this scenario is that portable memory cards have a very small form factor and are easily lost or damaged.

Enclosures exist for storing portable memory cards. For example, clam shell type enclosures for holding portable memory cards for GPS devices are currently available. However, such enclosures are cumbersome to carry and sometimes difficult to open. In addition, because such enclosures are separate from the host, they may not travel with the host and are subject to some of the same problems, e.g., loss or unavailability, as portable memory cards that are loosely carried separately from the host.

Accordingly, in light of these difficulties, there exists a need for improved holders for portable memory cards and methods for manufacturing such holders.

SUMMARY

Holders for portable memory cards and methods for manufacturing such holders are provided. A holder for a portable memory card described herein is configured to attach to a host device such that a portable memory card can travel with a host even when the portable memory card is not being used with the host. A holder for a portable memory card described herein may have a low profile design compatible with host electronic devices of increasingly small form factor, such as mobile phones and portable media players. A holder for a portable memory card may also include a lock for locking a portable memory card in a compartment formed by the memory card holder to prevent accidental removal of the portable memory card from the compartment.

BRIEF DESCRIPTION OF THE DRAWINGS

Preferred embodiments of the subject matter described herein will now be explained with reference to the accompanying drawings of which.

DETAILED DESCRIPTION

Figure 1:
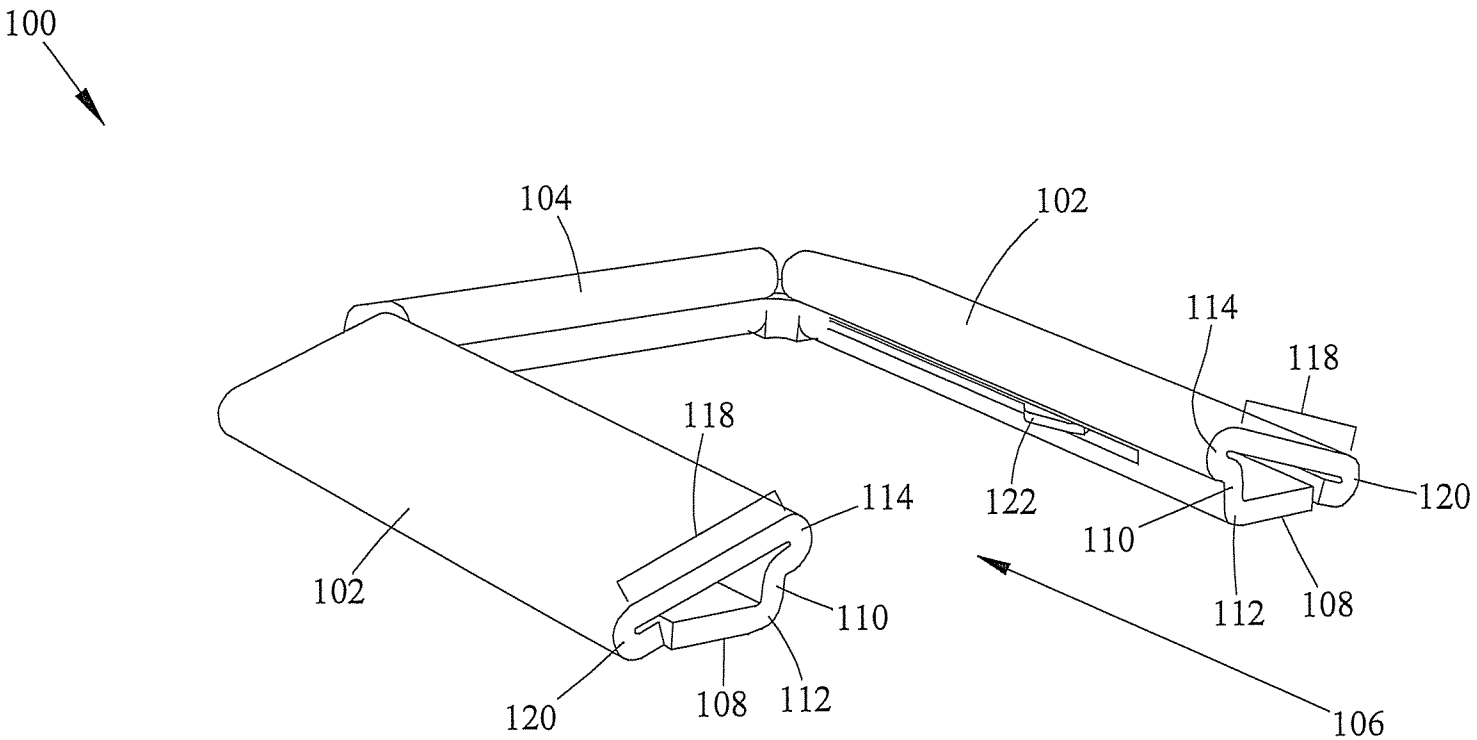
FIG. 1 is a front perspective view of a holder for a portable memory card according to an embodiment of the subject matter described herein.

Holders for portable memory cards and methods for manufacturing the same are disclosed. According to one aspect, a low profile holder for a portable memory card can be formed from sheet metal. FIG. 1 is a front perspective view of such a memory card holder according to an embodiment of the subject matter described herein. Referring to FIG. 1, memory card holder 100 includes first and second sidewall members 102 and end wall member 104 that frame a compartment 106 for receiving a portable memory card. Compartment 106 may be an opening, a slot, a niche, a gap, or any other suitable structure for receiving a portable memory card. Each of sidewall members 102 include a base portion 108 for attaching same to a host, such as a media player, a mobile phone, a smart phone, a PDA, a GPS device, a camera, a radio, or combinations thereof. Each of sidewall members 102 also include a sidewall portion 110 that extends outward from base portion 108. In particular, sidewall portions 110 extend outward from ends 112 of base portion 108 that are closest to compartment 106. Each sidewall member 102 also includes an overhanging portion 114 that extends from sidewall portion 110 over compartment 106 at an oblique angle for holding a portable memory card within compartment 106 and, if no backing is included, against a surface of a host, represented by reference numeral 116 in FIG. 1. Each overhanging portion 114 includes a 180° bend and a sloped portion 118 that extends over base portion 108. Each sloped portion 118 also includes a 180° bend 120 that forms a rounded outer edge of each sidewall member 102.

Figure 4:
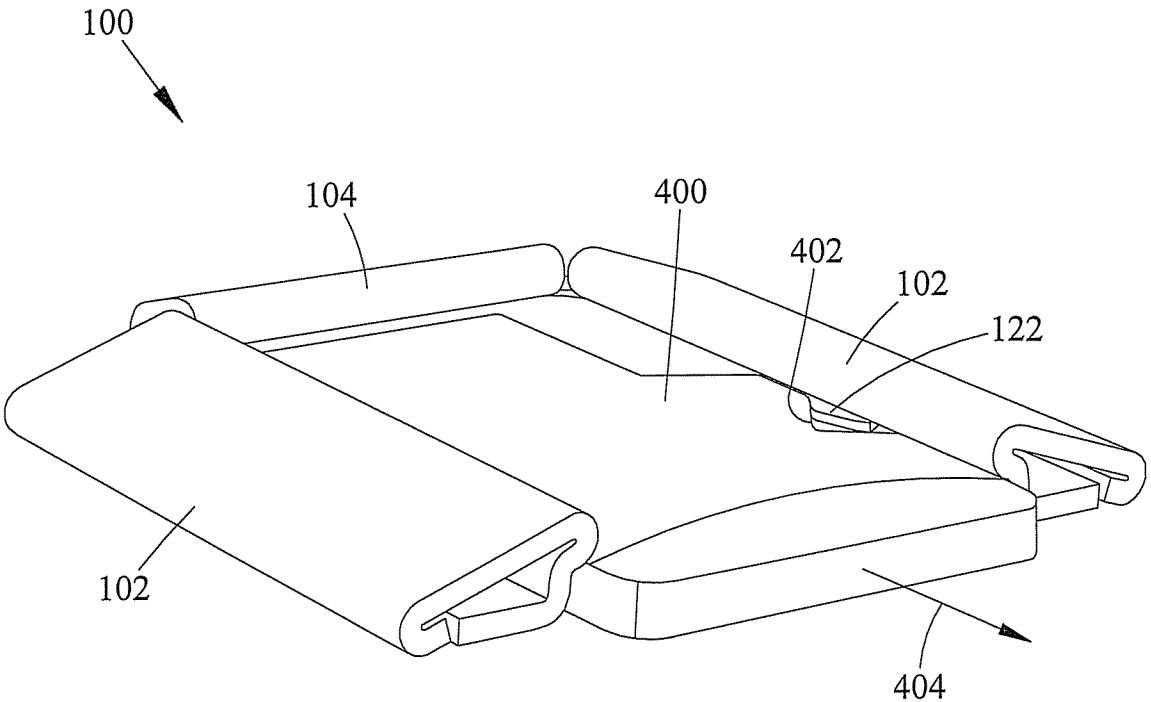
FIG. 4 is a front perspective view of the memory card holder of FIG. 1 and a portable memory card inserted therein.

One or both sidewall members 102 may include a spring lock 122 that engages a structure formed in an edge of a portable memory card. Spring lock 122 may include a cantilever beam and a tip that protrudes into compartment 106 and engages the structure on an edge of a portable memory card when the portable memory card is inserted into compartment 106. For example, some portable memory cards, such as micro secure digital (micro-SD) cards, include a slot formed in one of the card's lateral edges. The tip formed on the end of the cantilever beam of spring lock 122 may protrude into the slot when the card is fully inserted into compartment 106 to lock the card within compartment 106, as illustrated in FIGS. 4 and 5. In one example, both sidewall members 102 may include spring locks 122 so that a portable memory card can be inserted in orientations that are flipped 180° from each other and still be locked into compartment 106.

Figure 2:
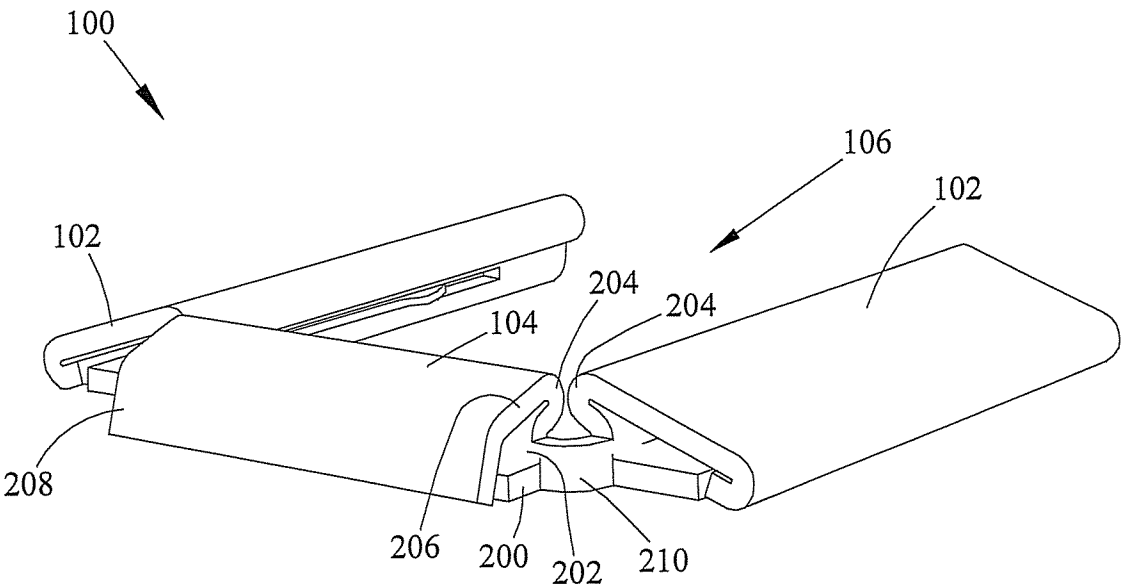
FIG. 2 is a rear perspective view of the memory card holder of FIG. 1.

FIG. 2 is a rear perspective view of memory card holder 100 of FIG. 1, illustrating the structure of end wall member 104 in more detail. In the illustrated example, end wall member 104 includes a base portion 200 designed for being attached to a host, a sidewall portion 202 that extends outward from base portion 200, and an overhanging portion 204 that extends from sidewall portion 202 over compartment 106 to retain a portable memory card within compartment 106. Overhanging portion 204 includes a 180° bend. End wall member 104 further includes a sloped portion 206 that extends from the 180° bend over base portion 200 of end wall member 104. End wall member 104 also includes a terminating portion 208 that extends over base portion 200. Joints 210 may be located on opposite ends of end wall member 104 to join end wall member 104 with sidewall members 102.

Figure 3:
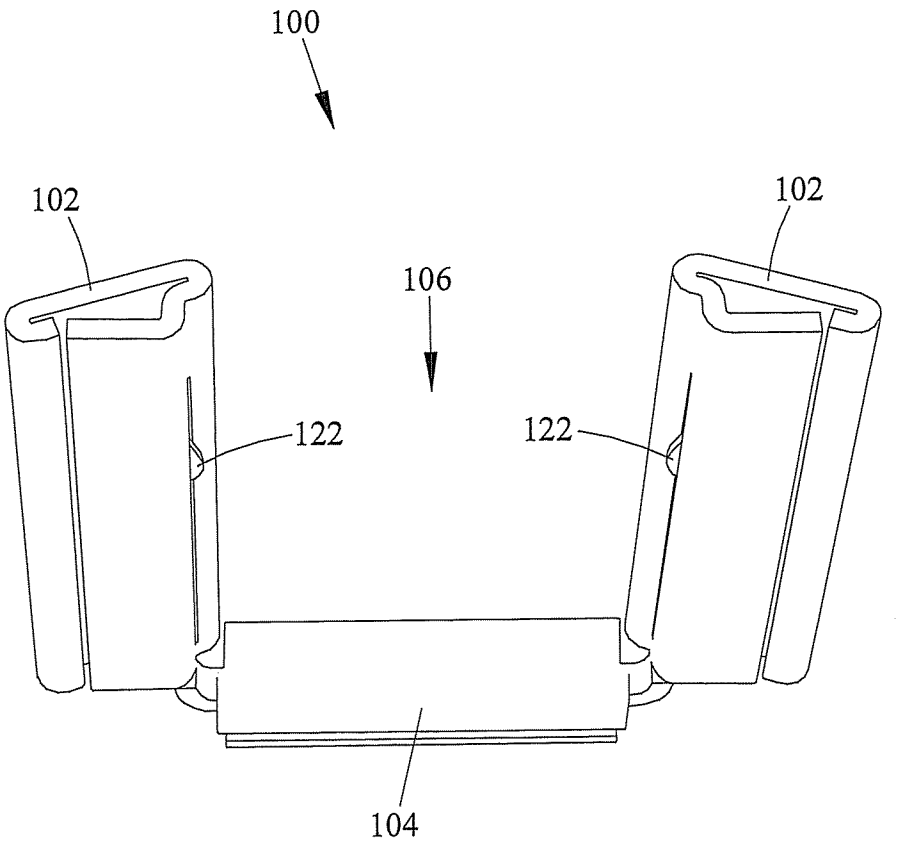
FIG. 3 is a bottom perspective view of the memory card holder of FIG. 1.

FIG. 3 is a bottom perspective view of memory card holder 100 of FIG. 1. In FIG. 3, the protrusions formed or located on the ends of spring locks 122 are shown on both side wall members 102 to allow locking with flipped orientations of a portable memory card. For example, portable memory cards, such as micro-SD cards, have asymmetric lateral edges. One lateral edge includes a structure that is engaged by the protrusion of spring lock 122. By including spring locks 122 in both sidewall members 102, a portable memory card can be inserted into compartment 106 with either of its major surfaces facing outward. In some examples, the major surface of a portable memory card may include a label that is indicative of the content of a portable memory card. If the user desires for the label to be displayed in holder 100 so that it can be viewed by the user or by others, the user may face the label outward. Alternatively, if privacy of the portable memory card content is desired, the user may desire to face the label inward towards the surface of the host device to which holder 100 attaches. By including spring locks 122 in both sidewall members 102, the user can lock the portable memory card in holder 100 with the option of either displaying or not displaying the label.

FIG. 4 is a front view of memory card holder 100 of FIG. 1 with a memory card 400 inserted therein. In FIG. 4, it can be seen that portable memory card 400 includes a structure on one of its lateral edges that is engaged by spring lock 122. In this configuration, portable memory card 400 can be disengaged from spring lock 122 through application of force in the direction of arrow 404. Such force may be generated by a user pulling memory card 400 with the user's finger in the direction of arrow 404.

In FIG. 4, and in the remaining figures herein, portable memory card 400 is a micro secure digital (micro-SD) card. In the examples described herein, compartment 106 is configured to receive a micro-SD card. However, compartment 106 may be configured to receive other types of removable portable memory cards without departing from the scope of the subject matter described herein.

Figure 5A:
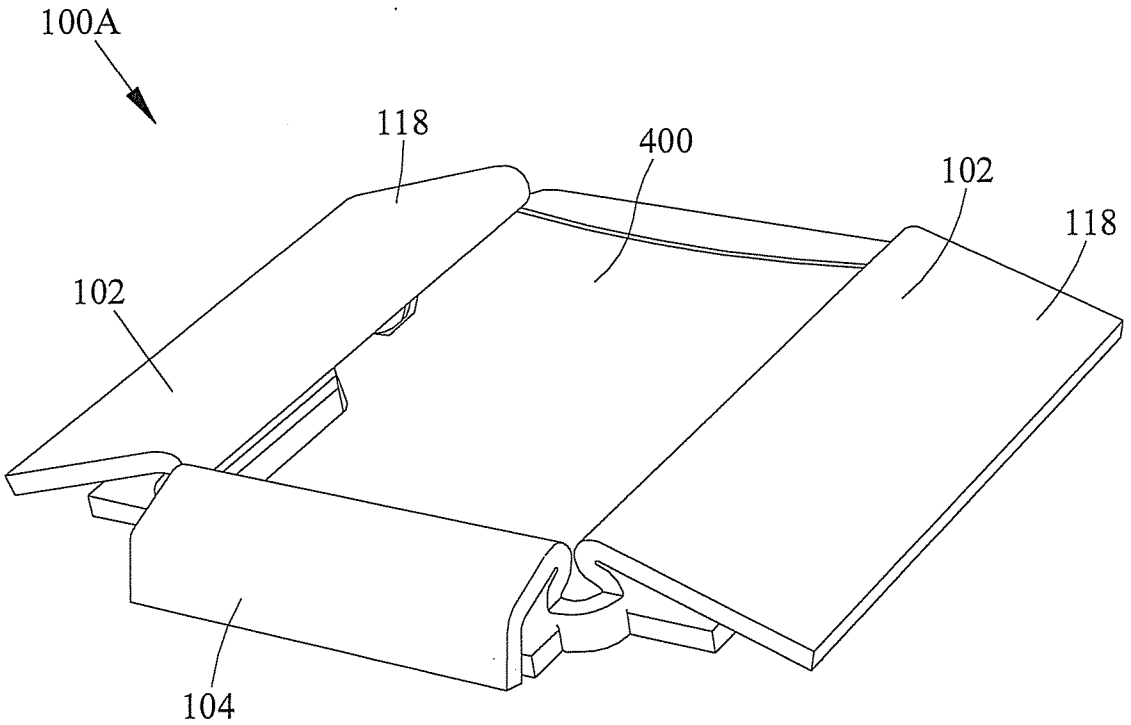
FIG. 5A is a top perspective view of a memory card holder illustrating locking of a portable memory card in the compartment according to an embodiment of the subject matter described herein.

FIG. 5A is a rear perspective view illustrating a memory card holder 100A that differs from memory card holder 100 illustrated in FIG. 1 in that sloped portions 118 of sidewalls 102 do not include outer 180° bends. The 180° bends in the outer portions of sidewalls 102 illustrated in FIG. 1 reduce the likelihood of the portable memory card catching on an object and being separated from the host. However, the outer bends can be omitted, as illustrated in FIG. 5A, without departing from the scope of the subject matter described herein.

Figure 5B:
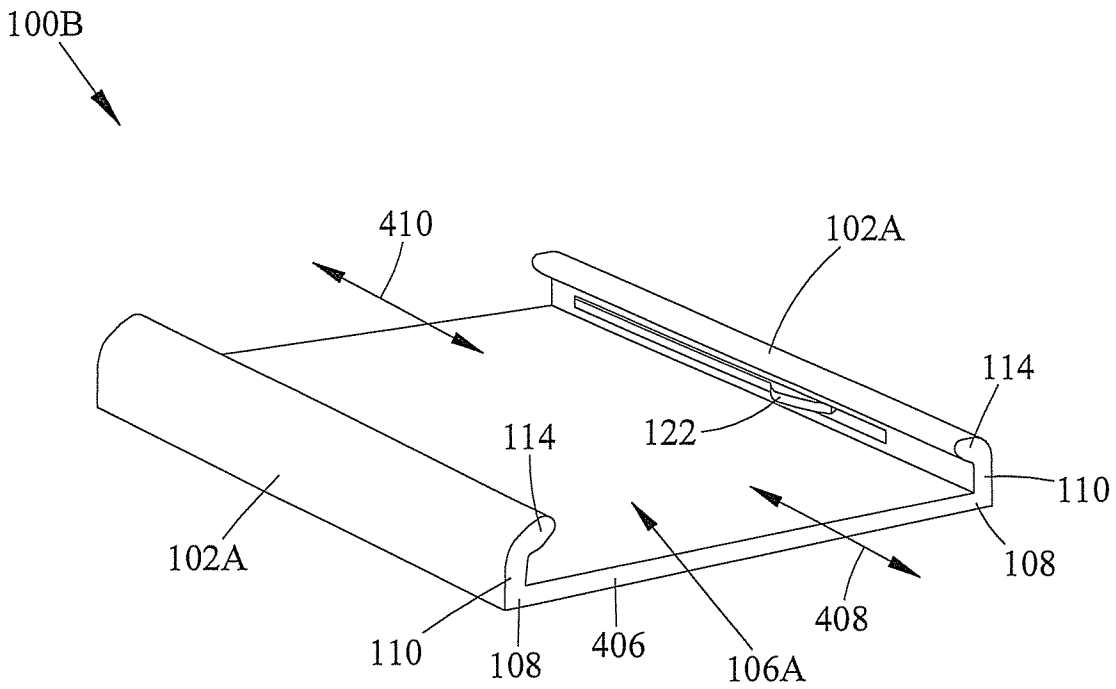
FIG. 5B is a front perspective view of a memory card holder according to an alternate embodiment of the subject matter described herein.

FIG. 5B is a front perspective view of an alternate embodiment of a memory card holder. Referring to FIG. 5B, memory card holder 100B includes sidewall members 102A that extend outward from a backing member 406. Each sidewall member 102A includes a base portion 108 and a sidewall portion 110 that extends outward from opposite ends of backing member 406. Each sidewall member 102A also includes an overhanging portion 114 that extends over compartment 106A. Compartment 106A is framed by sidewall members 102A. Spring lock 122 locks portable memory cards within compartment 106A.

In the embodiment illustrated in FIG. 5B. both ends of compartment 106A are substantially open such that a memory card can be inserted or removed from either end of compartment 106A, as illustrated by arrows 408 and 410, because sidewall member 104 illustrated in FIG. 1 is omitted. Spring lock 122 locks the portable memory card within compartment 106A. Backing member 406 increases the structural rigidity of portable memory card holder 100B and provides increased surface area for attaching to a host.

Figure 5C:
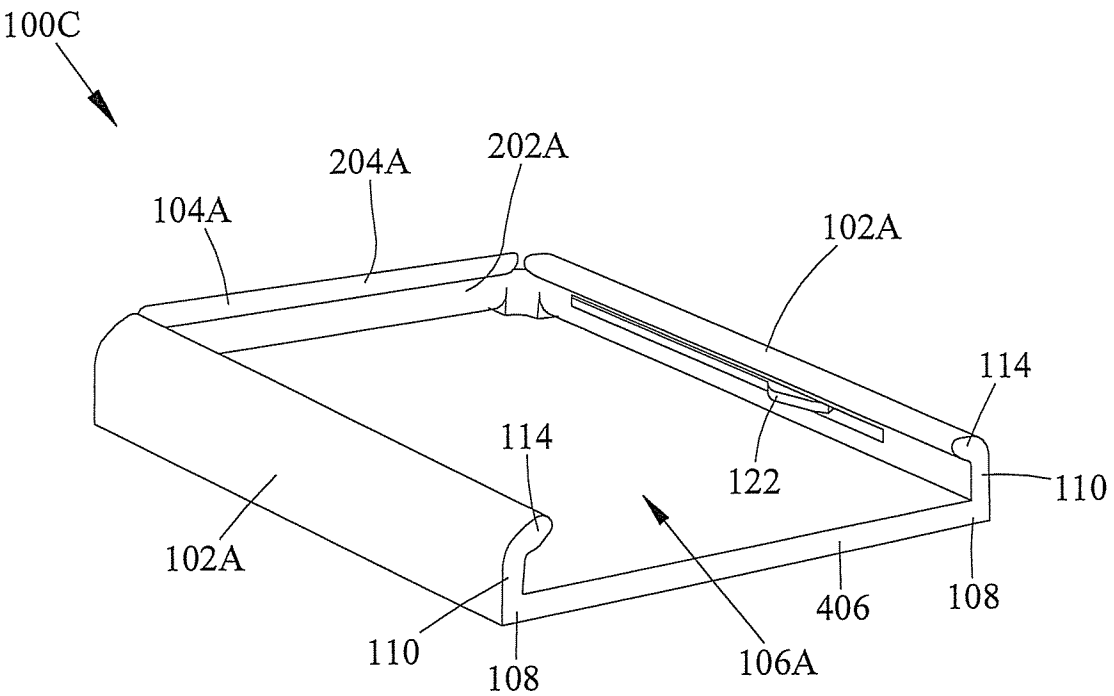
FIG. 5C is a front perspective view of a memory card holder according to yet another alternate embodiment of the subject matter described herein.

FIG. 5C illustrates yet another embodiment of a memory card holder. Referring to FIG. 5C, memory card holder 100C includes sidewall members 102A and backing member 406 as illustrated in FIG. 5B. However, portable memory card holder 100C includes endwall member 104A. Endwall member 104A includes overhanging portion 204A that extends over compartment 106A at an oblique angle to attain a portable memory card within compartment 106A and a sidewall member 202A that extends outward from backing member 406. Like the embodiment illustrated in FIG. 5B, memory card holder 100C provides increased surface area via backing member 406 for attaching to a host.

Figure 6A:
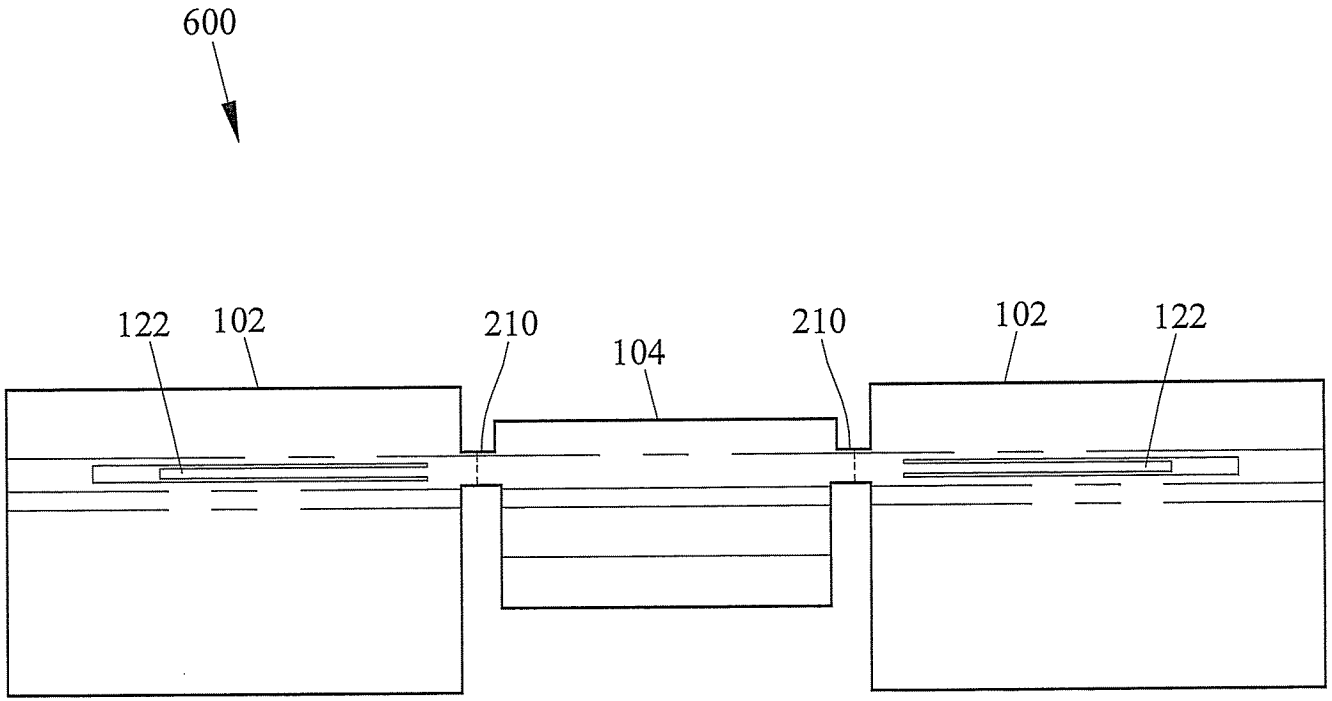
FIG. 6A is a top view illustrating unitary structure used to form the memory card holder of FIG. 1 and lines for bending the sidewall members and the end wall member to form the memory card holder of FIG. 1.

As stated above, in one exemplary implementation, memory card holder 100 illustrated in FIG. 1 can be formed using a single sheet of rigid material, such as sheet metal. FIG. 6A illustrates a unitary structure punched out from a single sheet of metal used to form memory card holder 100. In FIG. 6A, a unitary structure 600 may be formed from a sheet of metal, for example, by punching or cutting unitary structure from the sheet of metal. In the illustrated example, unitary structure 600 includes sidewall members 102, end wall member 104, and joints 210. The dashed lines in FIG. 6A correspond to bending locations used to form the various structures illustrated in FIG. 1. Spring locks 122 are also illustrated in FIG. 6A. Spring locks 122 may be formed by cutting out on three sides a cantilever beam and then bending the end of the cantilever beam to form the protrusion that engages the structure in the edge of a portable memory card.

Figure 6B:
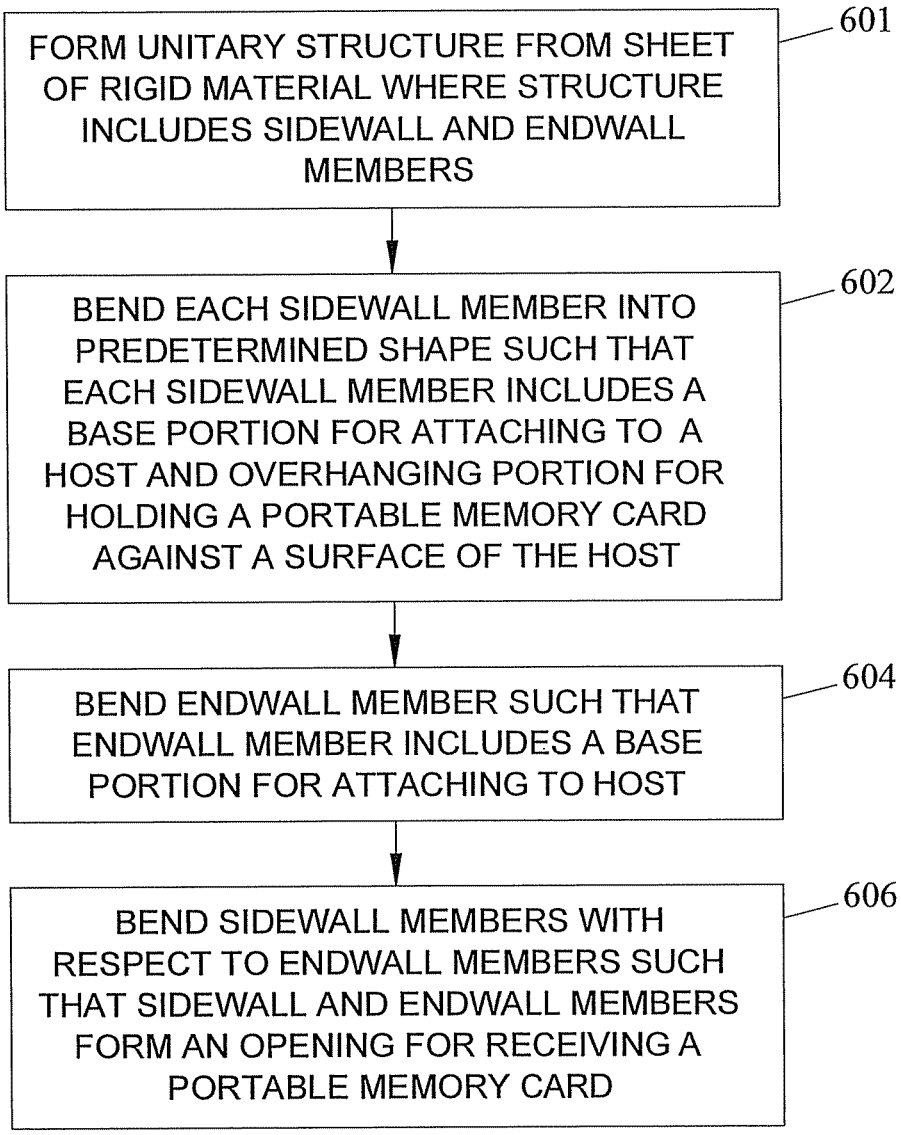
FIG. 6B is a flow chart illustrating exemplary steps for manufacturing the memory card holder of FIG. 1.

FIG. 6B is a flow chart illustrating exemplary steps for manufacturing memory card holder 100 illustrated in FIG. 1. Referring to FIG. 6B, in step 601, a unitary structure is formed from a sheet of rigid material where the structure includes sidewall and end wall members. For example, the structure illustrated in FIG. 6A may be punched or cut from a sheet of metal, such as cold rolled steel or aluminum. In step 602, each sidewall member 102 is bent into a predetermined shape such that each sidewall member 102 includes a base portion for attaching to a host and an overhanging portion for holding a portable memory card against the surface of the host. For example, sidewall members 102 illustrated in FIG. 6A may be bent along the dashed lines of FIG. 6A to form the shape of each sidewall member 102 illustrated in FIG. 1.

Returning to FIG. 6B, in step 604, the end wall member 104 is bent such that the end wall member includes a base portion for attaching to a host. The end wall member may also include an overhanging portion. For example, referring to FIG. 6A, end wall member 104 may be bent along the dashed lines to form the shape of end wall member 104 illustrated in FIG. 2.

In step 606, joints 210 are bent such that the sidewall and end wall members frame a compartment for receiving a portable memory card. For example, sidewall members 102 may be bent radially inward about joints 210 (i.e., in a direction out of the page in FIG. 6A) to frame compartment 106 illustrated in FIG. 1.

Figure 7:
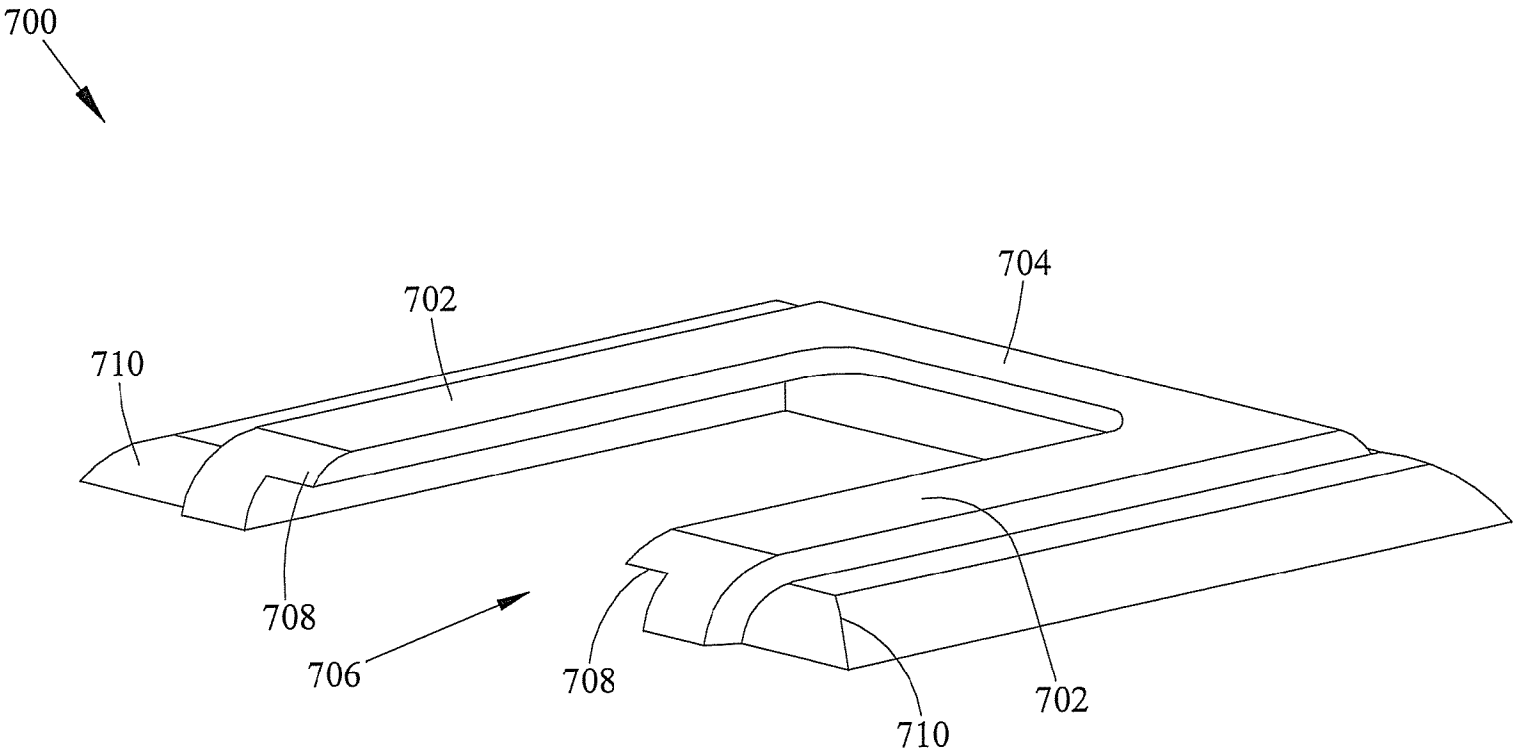
FIG. 7 is a front perspective view illustrating a holder for a portable memory card according to another embodiment of the subject matter described herein.

In the examples illustrated in FIGS. 1-6B, a portable memory card is formed by bending a sheet of rigid material. In an alternate implementation, a portable memory card may be formed by a molding process, such as injection molding, and may be made of a plastic material. In yet another example, a memory card holder may be formed by a rapid prototyping process where the structure of the holder is made directly from CAD or other mechanical drawings using sheets or layers of a composite material. FIG. 7 illustrates an example of a memory card holder that can be formed by a molding or rapid prototyping process according to an embodiment of the subject matter described herein. Referring to FIG. 7, memory card holder 700 includes sidewall members 702 and end wall member 704 that frame a compartment 706. Each sidewall member includes an overhanging portion 708 that holds a portable memory card against a surface of a host. In addition, each sidewall member 702 forms a tiered wall with an outer wall portion 710 that is of a lower height than overhanging portion 708. Forming outer wall portion 710 of a lower height than overhanging portion 704 reduces the amount of material required to manufacture memory card holder 700.

Figure 8:
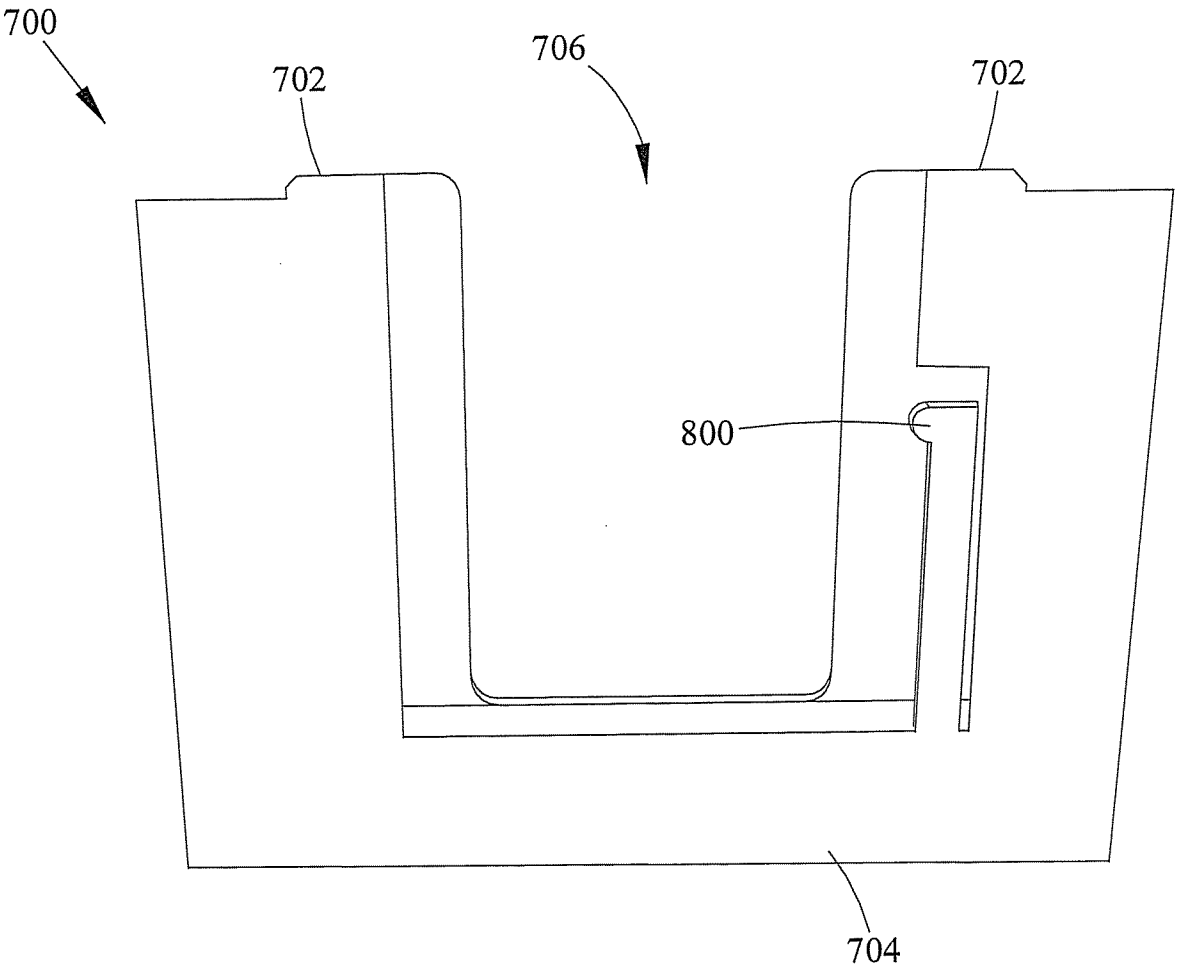
FIG. 8 is a bottom view of the memory card holder of FIG. 7.
Figure 9:
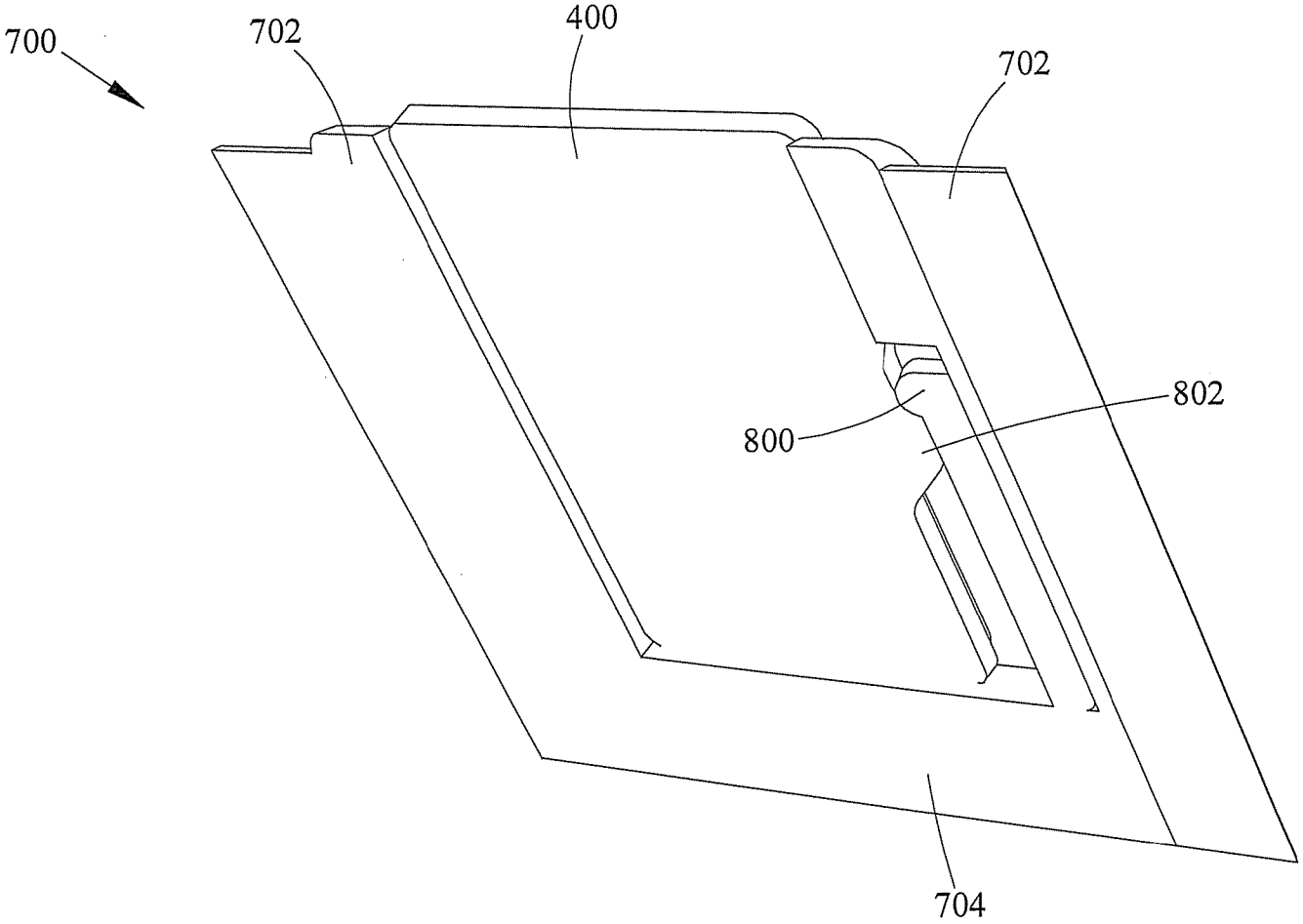
FIG. 9 is a bottom perspective view of the memory card holder of FIG. 7 with a portable memory card inserted therein.

FIG. 8 is a bottom view of memory card holder 700 illustrated in FIG. 7. In FIG. 8, one of the sidewall members 702 includes spring lock 800 that engages the structure on an edge of the portable memory card to lock the portable memory card in compartment 706, as illustrated in FIG. 9. In particular, in FIG. 9, spring lock 800 engages structure 802 that is found on one side of portable memory card 400. In an alternate embodiment of the subject matter described herein, memory card holder 700 may include spring locks 800 in both sidewall members 702 such that portable memory card 400 can be inserted in the orientation illustrated in FIG. 9 or in an orientation that is flipped 180° from the orientation illustrated in FIG. 9.

Figure 10:
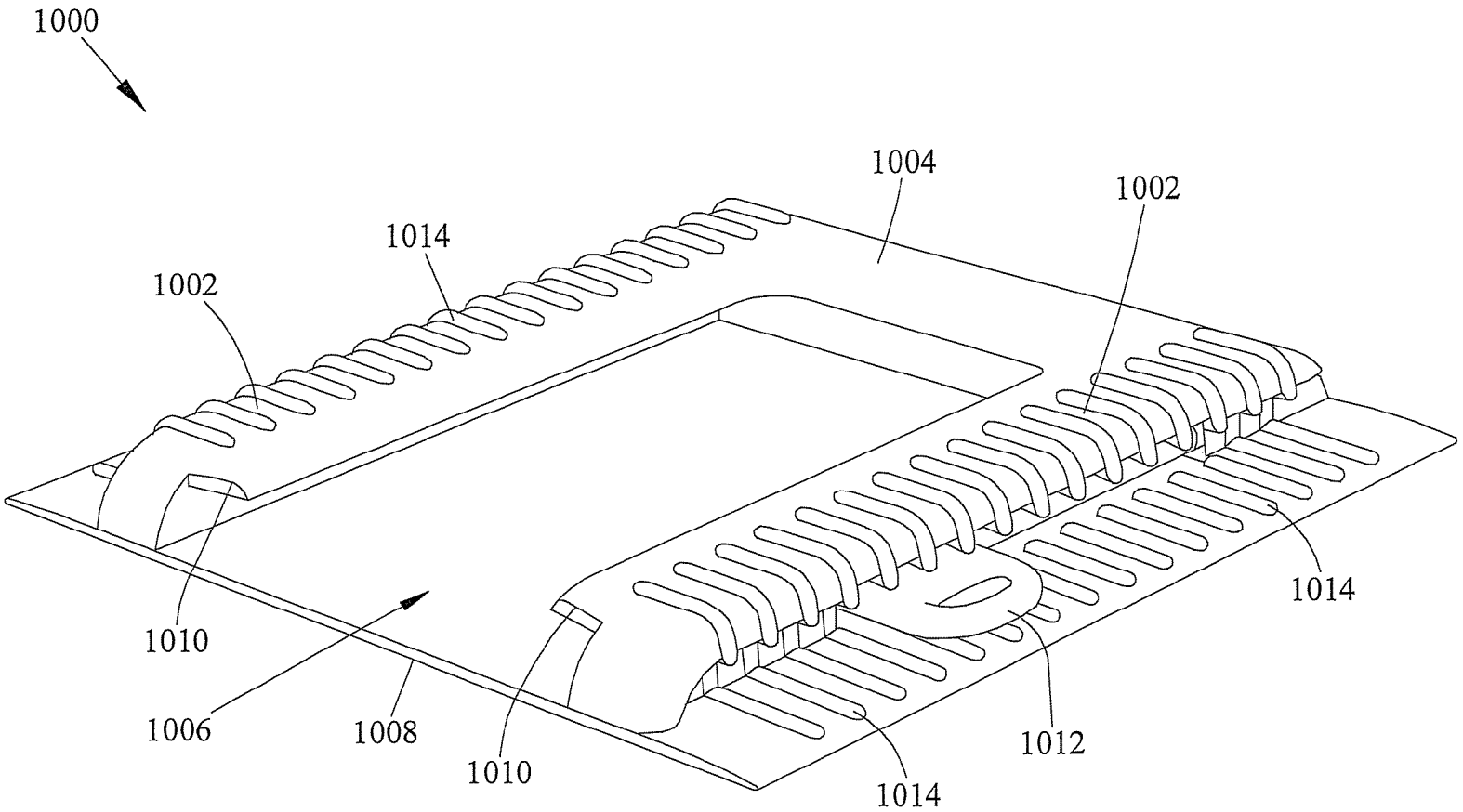
FIG. 10 is a front perspective view of a memory card holder according to another embodiment of the subject matter described herein.
Figure 11:
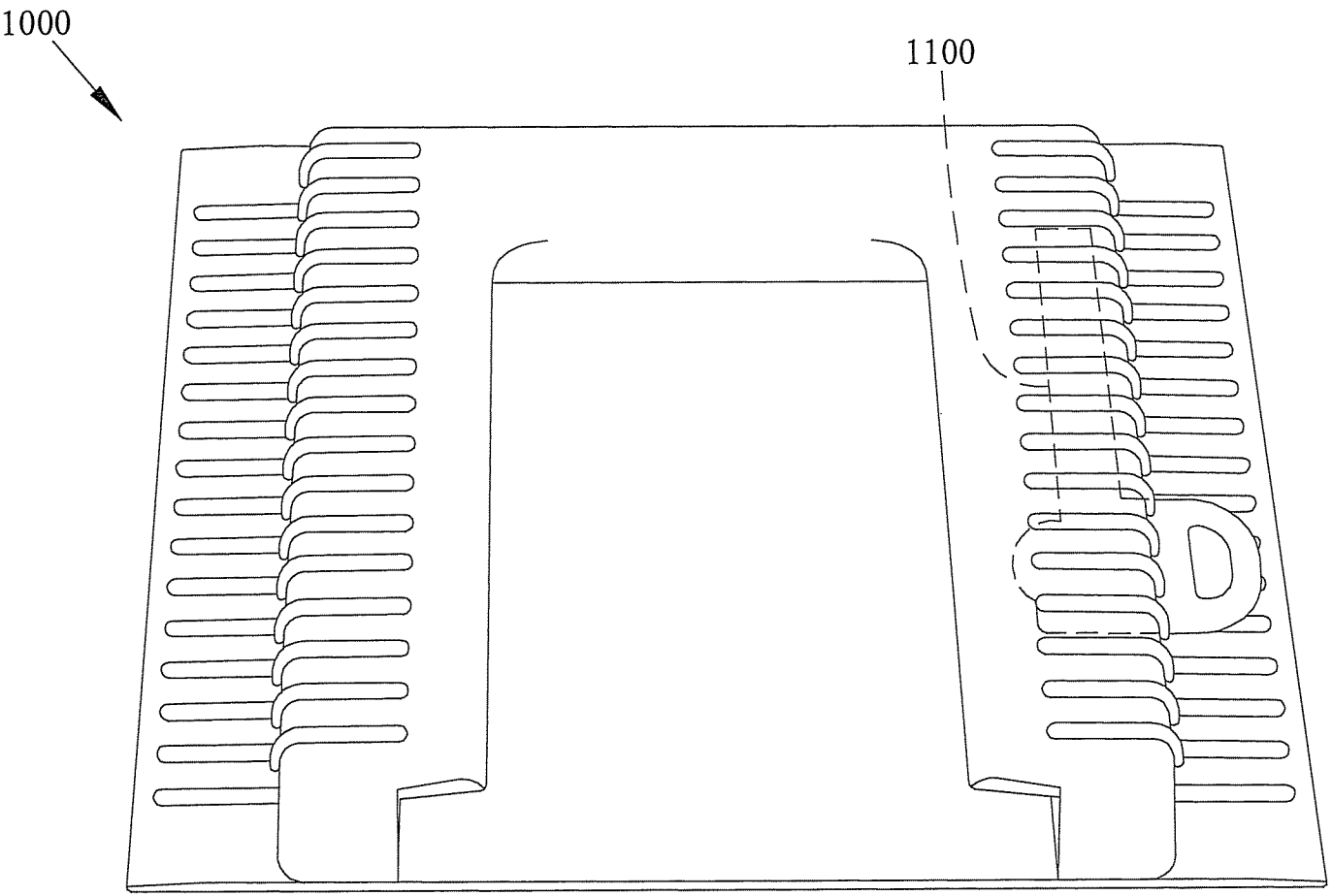
FIG. 11 is a top perspective view of the memory card holder of FIG. 10.

FIG. 10 illustrates yet another example of a memory card holder according to an embodiment of the subject matter described herein. Referring to FIG. 10, memory card holder 1000 includes sidewall members 1002 and end wall member 1004 that form compartment 1006 for receiving a portable memory card. In addition, memory card holder 1000 includes a backing member 1008 that attaches to a host and that provides structural support for sidewall members 1002 and end wall member 1004. Memory card holder 1000 further includes a spring lock 1100 illustrated by dashed lines in FIG. 11 that engages a structure in an edge of a portable memory card in a manner similar to spring lock 122 illustrated in FIG. 1. That is, spring lock 1100 may include a cantilever beam with a protrusion on its tip that engages the structure in the edge of a portable memory card. In FIGS. 10 and 11, an actuator 1012 may be located on the opposite side of the cantilever beam from the protrusion that engages the structure and the edge of a portable memory card and may be accessible from an external surface of memory card holder 1000. Actuator 1012 may be used to disengage spring lock 1100 from the structure in the edge of the portable memory card. Memory card holder 1000 may also include a plurality of parallel ridges 1014. Ridges 1014 may increase the aesthetic appeal of memory card holder 1000 and may also increase the ability of a user to grasp memory card holder 1000.

Figure 12:
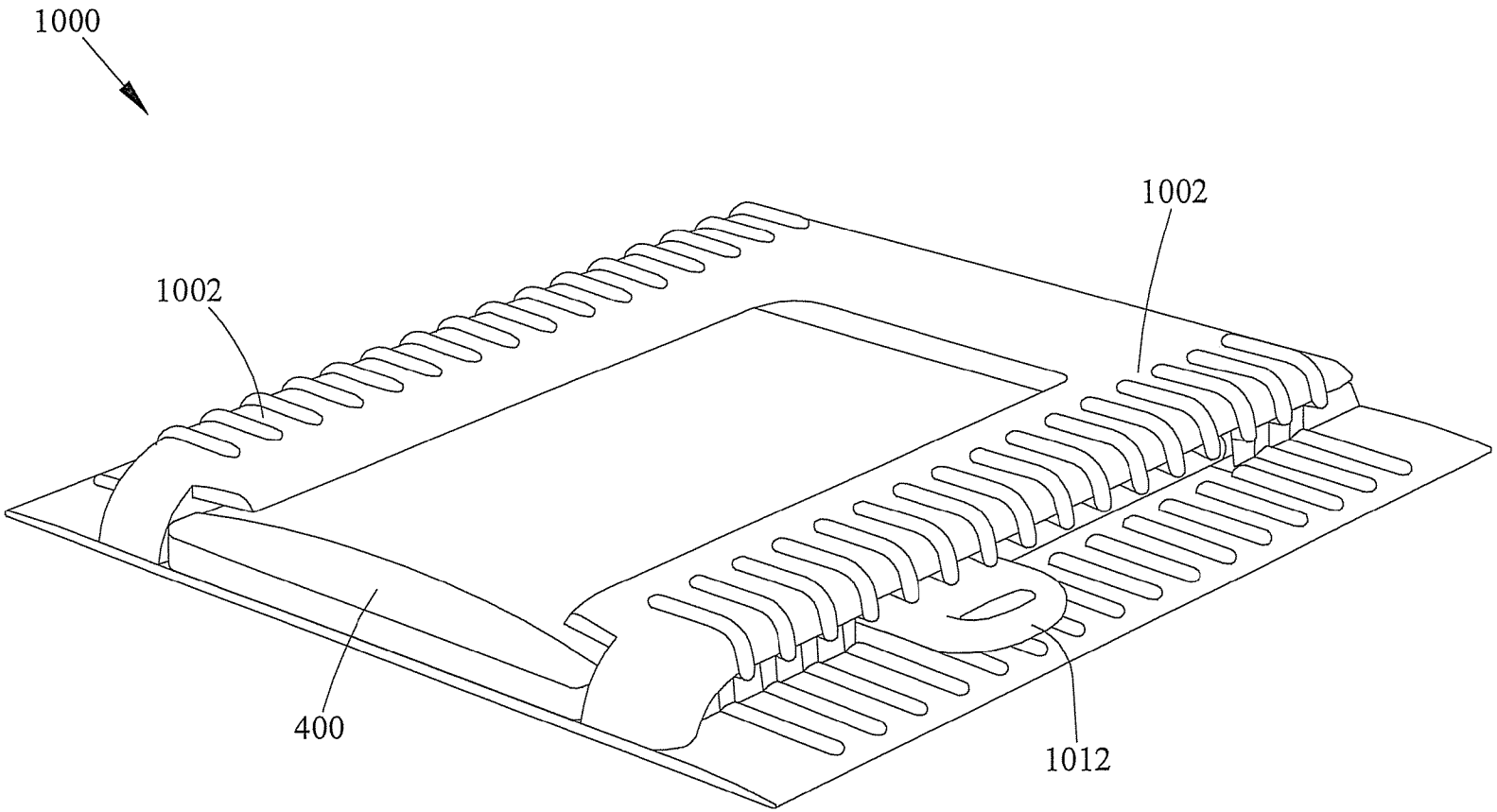
FIG. 12 is a front perspective view of the memory card holder of FIG. 10 with a portable memory card inserted therein.

When a memory card is inserted into memory card holder 1000, as illustrated in FIG. 12, a user may disengage spring lock 1100 by pulling actuator 1012 away from sidewall member 1002, in the direction corresponding to arrow 1200. Providing an externally accessible spring lock actuator facilitates removal of memory card 400 from memory card holder 1000.

Figure 13C:
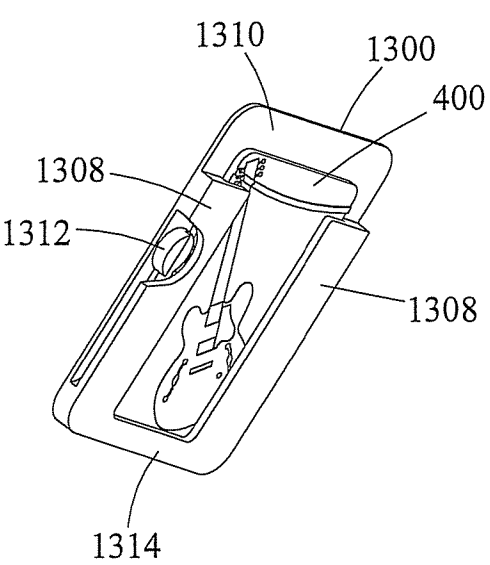
FIG. 13C is a perspective view of a memory card holder with a portable memory card inserted therein according to another embodiment of the subject matter described herein.
Figure 13B:
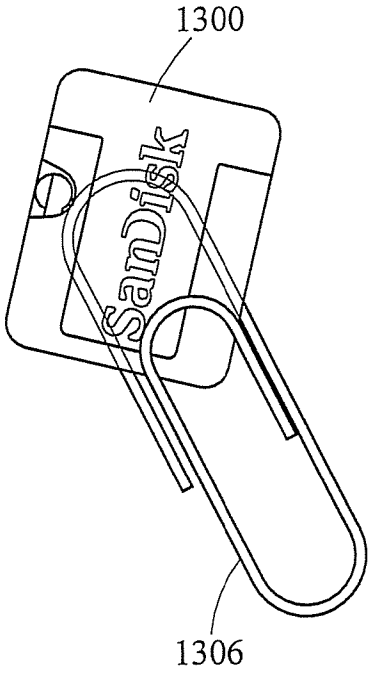
FIG. 13B is a front view of a memory card holder and a paper clip to illustrate an exemplary size of a memory card holder according to an embodiment of the subject matter described herein.
Figure 13A:
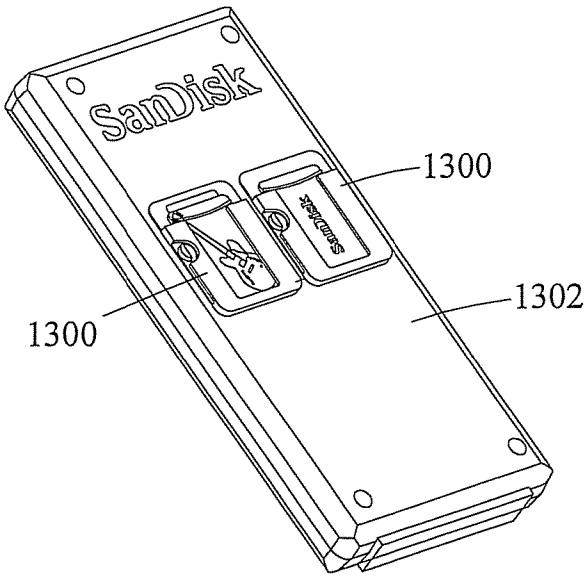
FIG. 13A is a perspective view of memory card holders attached to a host according to an embodiment of the subject matter described herein.

FIGS. 13A-13C illustrate additional examples and uses of a memory card holder according to embodiments of the subject matter described herein. In FIG. 13A, memory card holders 1300 are attached to host 1302. Memory card holders 1300 may have the same configuration as any of the memory card holders described hereinabove or may have a slightly different configuration, as will be described with regard to FIGS. 13B and 13C. Host 1302 may be a portable media player, a mobile phone, or any of the host devices mentioned herein. In FIG. 13B, memory card holder 1300 is shown with a paper clip 1306 to illustrate the small size and low profile of memory card holder 1300. For example, memory card holder 1300 may have a thickness of no more than about 2 millimeters. In addition, memory card holder 1300 may include at least one transparent surface.

In FIG. 13C, memory card holder 1300 is shown with a memory card 400 inserted therein. Memory card holder 1300 includes sidewall members 1308 that hold memory card 400 against a backing member 1310 that attaches to the host device. A spring lock (not shown in FIG. 13C, but similar in structure to spring lock 122) that engages a structure in an edge of portable memory card 400 may be disengaged from the structure in the edge of portable memory card 400 using spring lock actuator 1312. Sidewall members 1308 and an end wall member 1314 may each include an overhanging portion that hold memory card 400 against backing member 1310.

Figure 14:
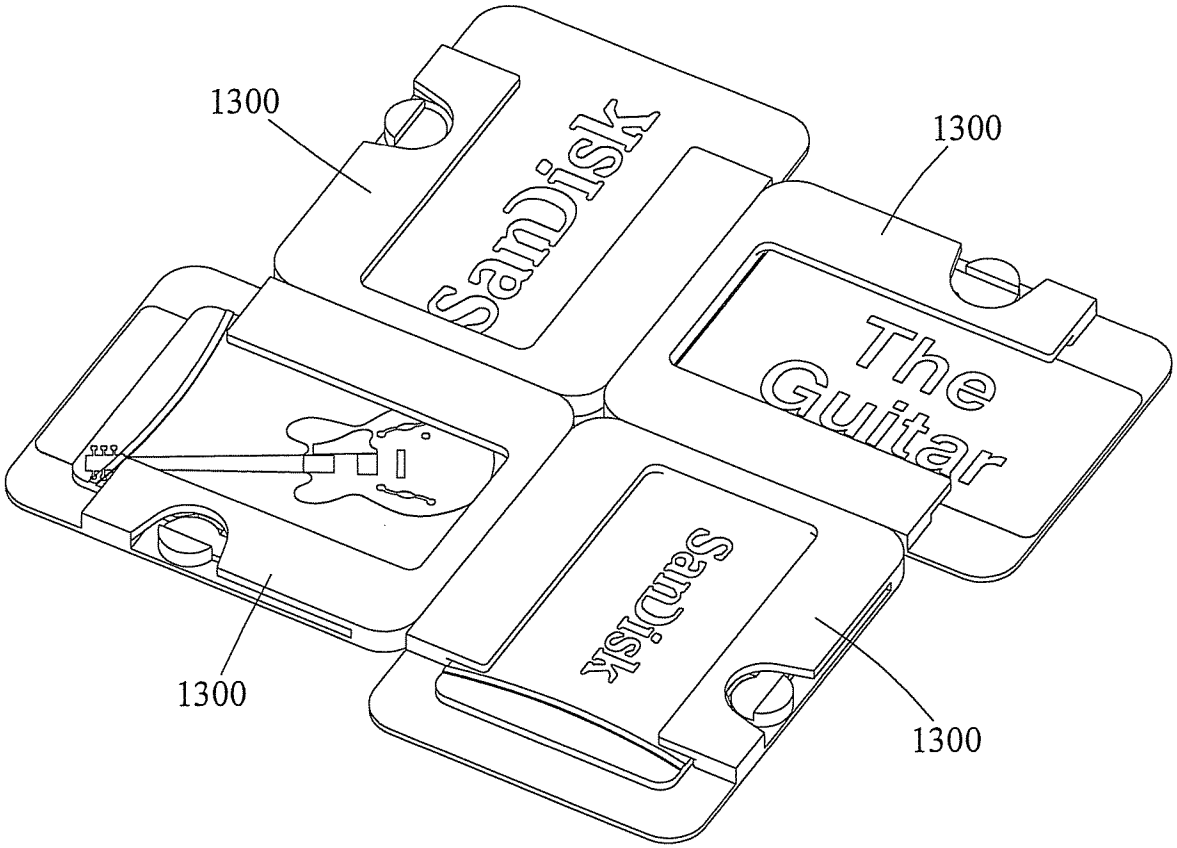
FIG. 14 is a top view illustrating memory card holders arranged in a vane configuration according to an embodiment of the subject matter described herein.

According to another aspect of the subject matter described herein, a plurality of memory card holders 1300 may be located on any surface and arranged in a vane configuration, as illustrated in FIG. 14. In FIG. 14, each memory card holder 1300 is arranged so that its compartment faces outward and does not face another memory card holder. This configuration is referred to herein as a vane configuration. In the example illustrated in FIG. 14, the vane configuration includes four memory card holders 1300 that extend radially outward from a common point or area such that memory cards can be slid radially outward from any of the memory card holders 1300. In an alternate example, the vane configuration may include two memory card holders facing radially outward from a common point or area.

Figure 15:
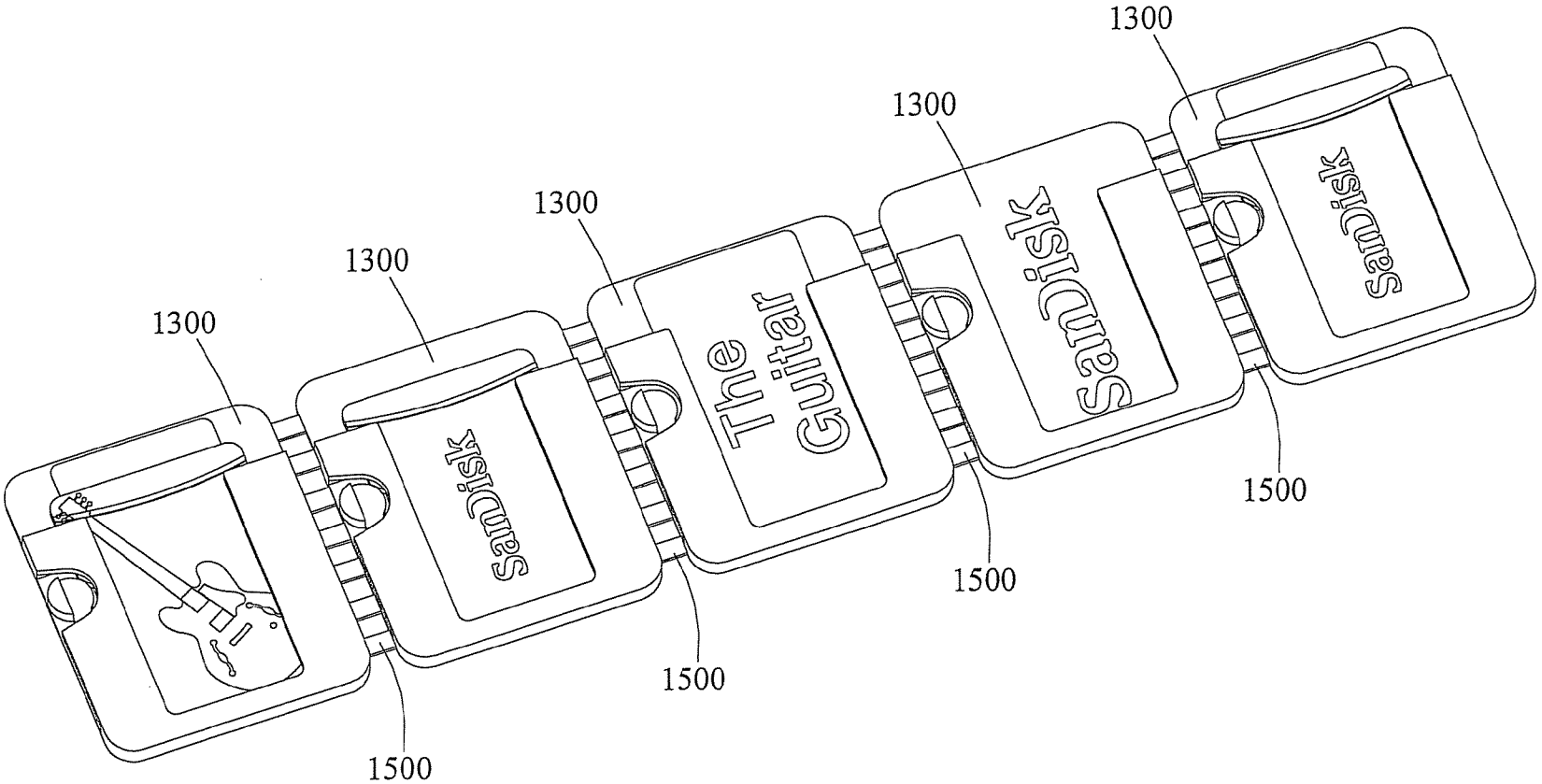
FIG. 15 illustrates a plurality of memory card holders that are arranged in a linear array and that are detachably coupled to each other according to an embodiment of the subject matter described herein.

According to another aspect of the subject matter described herein, a plurality of memory card holders can be detachably coupled to each other for storage, removal, and distribution. For example, as illustrated in FIG. 15, memory card holders 1300 are arranged in a linear array and are joined by perforations 1500 formed between adjacent sidewall members 1308 (shown in FIG. 13C). In the configuration illustrated in FIG. 15, the linear array of memory card holders 1300 may be owned by a distributor, such as an artist or a media rights holding company. As individual memory cards are sold or otherwise distributed to end users, the individual memory card holders 1300 may be torn from the linear array along perforations 1500 and distributed to the end users.

Figure 16:
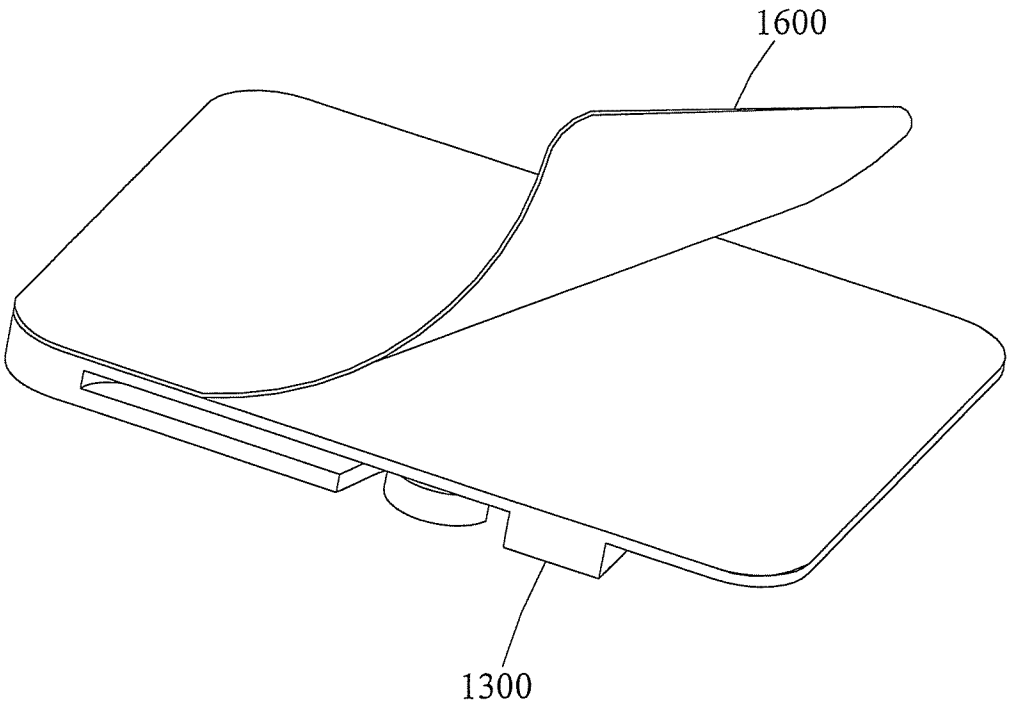
FIG. 16 is a bottom perspective view illustrating an adhesive backing for a memory card holder according to an embodiment of the subject matter described herein.

FIG. 16 illustrates an example of an adhesive backing on a memory card holder 1300 that may be used to attach the portable memory card to a host. In the illustrated example, portable memory card holder 1300 includes an adhesive material located on a back surface thereof and covered by a removable cover 1600. When removable cover 1600 is removed, memory card holder 1300 can be attached to a host using the adhesive material that is deposited on its back surface. In an alternate example, the back surface of memory card holder 1300 may include either a sheet of hooks or loops to form a hook and loop fastener connection with the corresponding loop or hook material located on a surface of the host device in which it is desirable to attach the portable memory card. In yet another example, if both memory card holder 1300 and the surface to which the memory card holder 1300 is to be attached are made of thermoplastic materials, memory card holder 1300 can be welded to the surface of the host device, for example, using an ultrasonic welding procedure. In some embodiments, especially those that use hook and loop fasteners to connect to a host, memory card holder 1300 or any of the other memory card holder examples illustrated herein may be detachably couplable to a host device so that the memory card holder can be attached to one host device, detached from that host device, and attached to a second host device.

In FIG. 16, portable memory card holder 1300 has a backing surface between its sidewalls that attaches to a host device. However, as illustrated in some of the examples above, the backing surface between the sidewalls may be omitted without departing from the scope of the subject matter described herein. That is, a portable memory card holder may include a backless design, where the only surfaces that can attach to a host are the base portions of the sidewall and end wall members.

Figure 17:
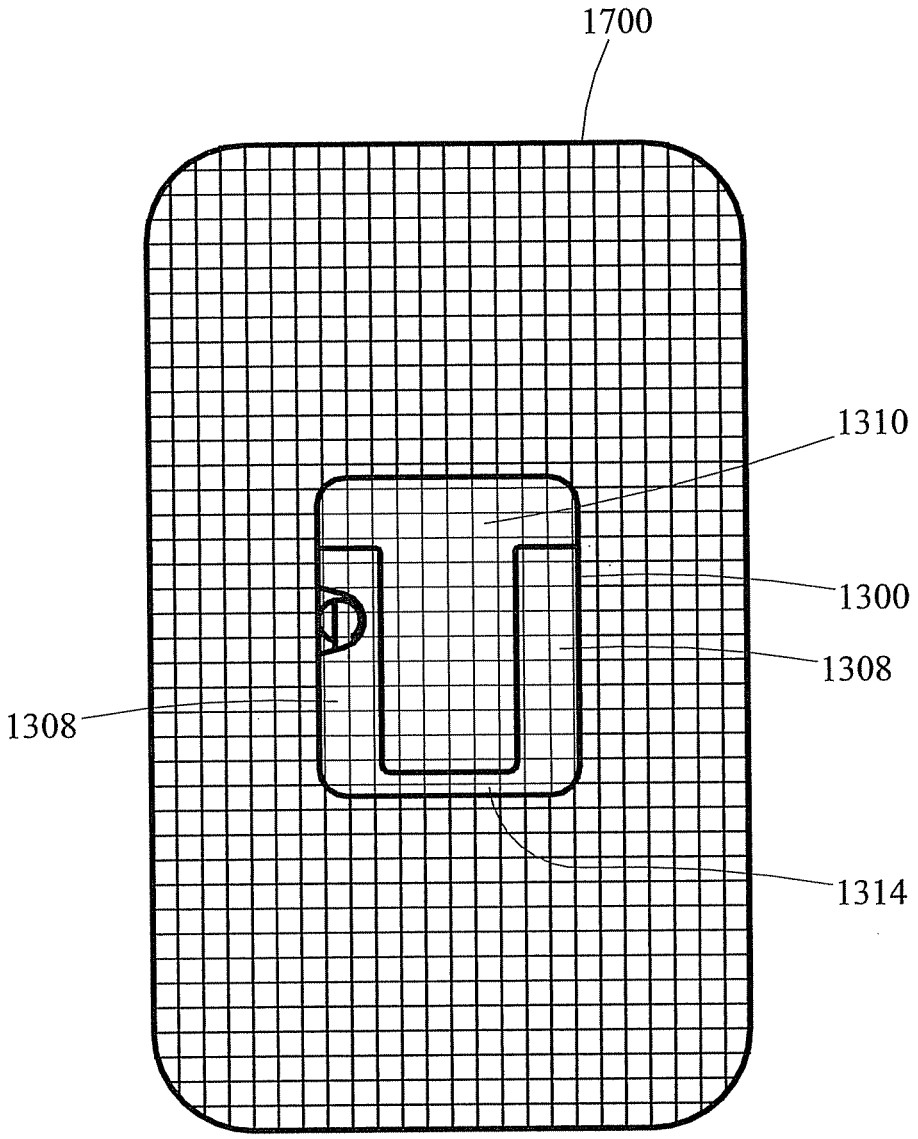
FIG. 17 is a diagram of a memory card holder attached to a host where the memory card holder is substantially transparent according to an embodiment of the subject matter described herein.

According to yet another aspect of the subject matter described herein, at least one surface of a memory card holder can be substantially clear or optically transparent, as illustrated in FIG. 17. In FIG. 17, each of backing member 1310, sidewall members 1308, and end wall member 1314 are formed of an optically transparent material, such as transparent plastic. As such, when memory card holder 1300 is attached to host device 1700, the surface of host device 1700 to which memory card holder 1300 is attached is not obscured.

Figure 18:
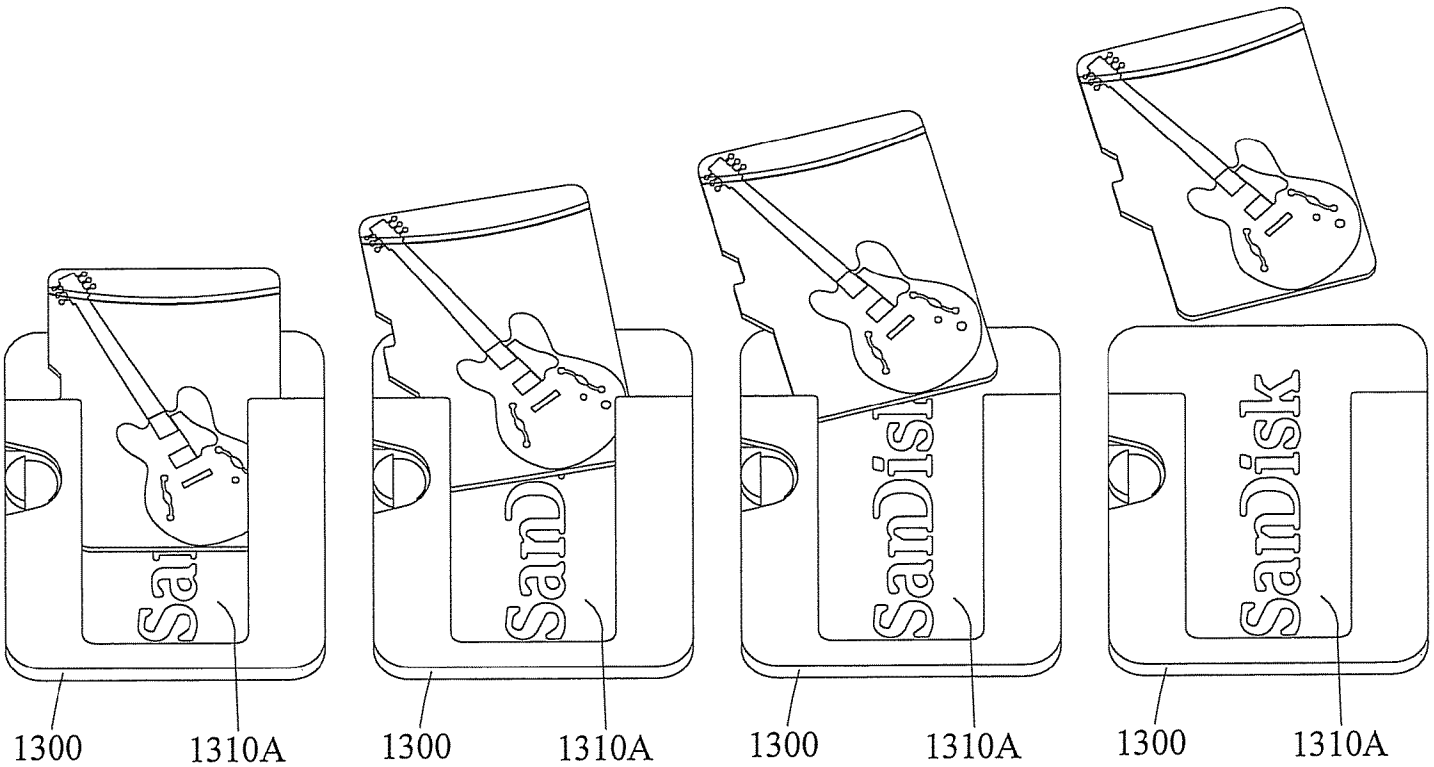
FIG. 18 illustrates a plurality of memory card holders with company logos on an outer-facing surface thereof according to an embodiment of the subject matter described herein.
Figure 19B:
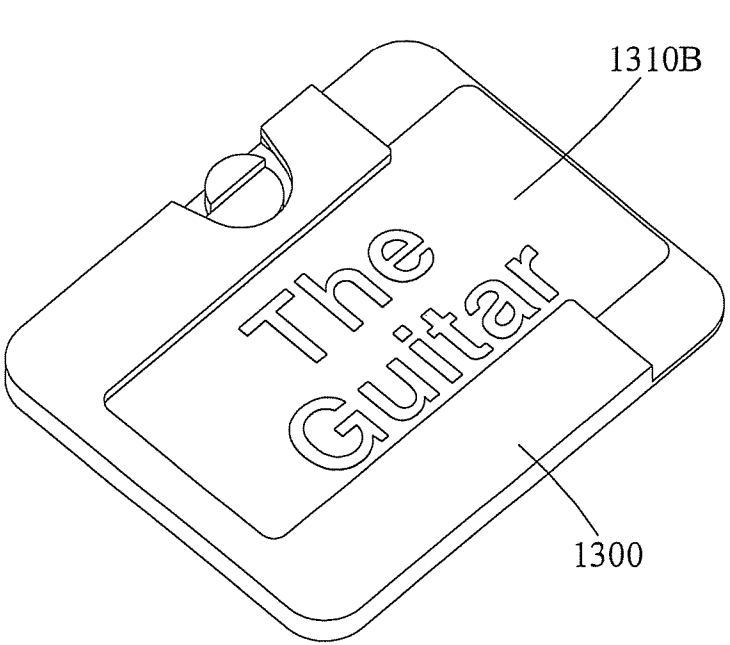
FIGS. 19A and 19B are memory card holders with displays on the backing surface that correspond to the memory card that is inserted therein according to an embodiment of the subject matter described herein.
Figure 19A:
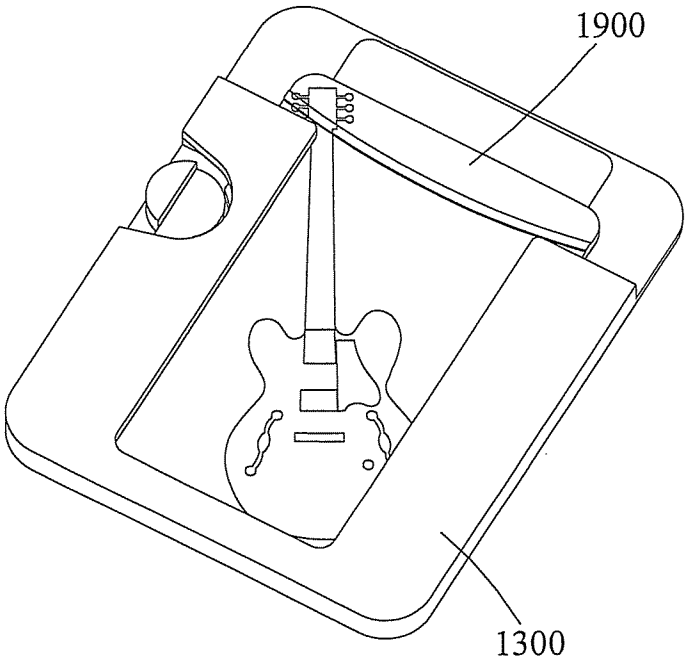

According to yet another aspect of the subject matter described herein, one or more surfaces of a memory card holder may include a display, as illustrated in FIGS. 18, 19A, and 19B. In FIG. 18, an outward facing surface of backing member 1310 is branded with the company logo. In FIG. 19B, the backing surface 1310 of memory card holder 1300 includes a graphical display that indicates the type of memory card that should be inserted. For example, in FIG. 19B, backing surface 1310 indicates "The Guitar" for portable memory card 1900 illustrated in FIG. 19A, which includes an image of a guitar.

As described above, the subject matter described herein includes holders for portable memory cards and methods for manufacturing same. According to one aspect, a holder for a portable memory card is provided. The holder includes first and second sidewall members framing a compartment for receiving a portable memory card. Each of the first and second sidewall members has a base portion designed for being attached to a host device, a sidewall portion extending outward from the base portion, and overhanging portion extending from the sidewall portion over the compartment at an oblique angle for retaining a portable memory card within the compartment.

According to another aspect of the subject matter described herein, another holder for a portable memory card is provided. The holder includes first and second sidewall members framing a compartment for receiving a portable memory card. Each of the first and second sidewall members includes a base portion designed for attaching same to the host and an overhanging portion extending over the compartment for retaining the portable memory card in the compartment and forming a tiered wall having an outer portion of lower height than the overhanging portion.

According to another aspect of the subject matter described herein, yet another holder for a portable memory card is provided. The holder includes first and second sidewall members framing a compartment for receiving a portable memory card. Each of the first and second sidewall members includes a base portion for attaching to the host, an overhanging portion extending over the compartment for retaining the portable memory card within the compartment, and at least one spring lock for engaging a structure in an edge of the portable memory card and locking the portable memory card within the compartment, where the at least one spring lock includes a lock actuator for disengaging the spring lock from the structure in the portable memory card.

According to yet another aspect of the subject matter described herein, a method for manufacturing a holder for a portable memory card is provided. The method includes forming a unitary structure from a sheet of rigid material, the unitary structure including first and second sidewall members, an end wall member, and joints between the sidewall members and the end wall member. The method further includes bending the sidewall members to form a base portion for attaching same to a host and an overhanging *lion for holding a portable memory card against a surface of the host. The method further includes bending the end wall member to include a base portion that attaches to the host. The method further includes bending the joints such that the sidewall members and the end wall member frame a compartment for receiving the portable memory card.

In the examples described above, different combinations and features are illustrated as being associated with different embodiments. However, any of the features of any embodiment can be combined with or omitted from the features of any other embodiment without departing from the scope of the subject matter described herein.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A holder for a portable memory card, the holder comprising:

first and second sidewall members framing a compartment;

each of the first and second sidewall members having a base portion designed for being attached to a host, a sidewall portion extending outward from the base portion, and an overhanging portion extending from the sidewall portion inward over the compartment at an oblique angle and for retaining the portable memory card within the compartment, wherein the holder is configured to attach to a host such that the portable memory card travels with the host even when the portable memory card is not being used by the host, wherein the host comprises a device into which the portable memory card is inserted during operation; and an end wall member that terminates one end of the compartment, wherein the end wall member includes a base portion, a sidewall portion extending outward from the base portion of the end wall member, an overhanging portion extending over the compartment from the sidewall portion of the end wall member at an oblique angle for retaining the portable memory card within the compartment, wherein the overhanging portion of the end wall member includes a 180° bend, and wherein the end wall member further includes a sloped portion extending from the bend in the overhanging portion and over the base portion of the end wall member.

2. The holder of claim 1 wherein the first and second sidewall members are formed from a single sheet of rigid material.

3. The holder of claim 2 wherein the rigid material comprises sheet metal.

4. The holder of claim 1 wherein the overhanging portion of the sidewall portion includes a 180° bend and wherein each of the sidewall members further includes a sloped portion extending from the 180° bend in the overhanging portion and over the base portion.

5. The holder of claim 4 wherein the sloped portion of each sidewall member includes a 180° bend to form a rounded outer edge of each sidewall member.

6. The holder of claim 1 wherein at least one of the sidewall members includes a spring lock for engaging a structure in an edge of the portable memory card to lock the portable memory card in the compartment.

7. The holder of claim 1 comprising a backing portion located between the base portions of the sidewall members for attaching to the host and wherein the compartment is open on both ends of the backing portion to allow insertion and removal of the portable memory card from either end of the backing portion.

8. The holder of claim 1 wherein the compartment is configured to receive a micro secure digital card.

9. The holder of claim 1 wherein the base portions of the sidewall members are detachably couplable to the host.

* * * * *